US005483880A

United States Patent [19]

Seo et al.

[11] Patent Number: 5,483,880

[45] Date of Patent: Jan. 16, 1996

[54] STAMP UNIT WHOSE PRINT FACE PORTION IS FORMED OF A HEAT SENSITIVE STENCIL PAPER

[75] Inventors: Keiji Seo, Nagoya; Takashi Miki, Toyoake, both of Japan

[73] Assignee: Brother Kogyo Kabushiki Kaisha, Nagoya, Japan

[21] Appl. No.: 337,214

[22] Filed: Nov. 7, 1994

[30] Foreign Application Priority Data

Nov. 30, 1993 [JP] Japan ..... 5-329656
May 24, 1994 [JP] Japan ..... 6-135108

[51] Int. Cl.[6] ..... B41K 1/32

[52] U.S. Cl. ..... 101/125; 101/333; 101/405

[58] Field of Search ..... 101/103, 109, 101/112, 114, 121, 125, 128.21, 128.4, 327, 333, 405, 406

[56] References Cited

U.S. PATENT DOCUMENTS

| | | | |
|---|---|---|---|
| 3,402,663 | 9/1968 | Funahashi | 101/327 |
| 3,570,396 | 3/1971 | Schwartzman | 101/125 |
| 3,832,947 | 9/1974 | Funahashi | 101/125 |
| 4,141,292 | 2/1979 | Hirata | 101/125 |
| 4,289,070 | 9/1981 | MacGregor | 101/327 |
| 4,441,422 | 4/1984 | Dreeben | 101/125 |
| 4,637,308 | 1/1987 | Vidoni | 101/125 |
| 4,649,819 | 3/1987 | Voto, Jr. et al. | 101/327 |
| 4,676,162 | 6/1987 | Phipps, Sr. et al. | 101/405 |
| 5,184,549 | 2/1993 | Imamaki et al. | 101/121 |
| 5,205,214 | 4/1993 | Seo et al. | 101/327 |
| 5,253,581 | 10/1993 | Miki et al. | 101/125 |
| 5,261,325 | 11/1993 | Bengtsson | 101/333 |
| 5,285,725 | 2/1994 | Imamaki et al. | 101/127.1 |
| 5,377,599 | 1/1995 | Wall et al. | 101/327 |

FOREIGN PATENT DOCUMENTS

| | | | |
|---|---|---|---|
| 0516399 | 5/1992 | European Pat. Off. . | |
| 891845 | 10/1953 | Germany . | |
| 336279 | 11/1992 | Japan | 101/125 |
| 347681 | 12/1992 | Japan | 101/128.4 |
| 85031 | 4/1993 | Japan | 101/125 |

*Primary Examiner*—Stephen Funk
*Attorney, Agent, or Firm*—Oliff & Berridge

[57] ABSTRACT

A stamp unit includes a grip portion to be grasped by a hand, a stamp portion that is fixedly linked to the grip portion, a skirt member covering the outer peripheral side of the stamp side, and a protection cap that is freely detachably mounted on the stamp portion. The skirt member is upwardly and downwardly slidably supported. At its nonuse time, the lower end of the skirt member projects to a position lower than a print face portion of the stamp portion. However, by locating the stamp unit at a print position and pressing the grip portion, the skirt member is moved upwardly, and the print face portion of the stamp member is pressed against a print surface, whereby ink oozes out from the print face portion to perform the print operation. The stamp unit is further provided with plural engaging holes formed at the lower portion of the grip member and plural engaging pawls that are provided at the upper portion of the stamp member and elastically engaged with the respective engaging holes. The grip member and the stamp member are mutually detachably mounted to each other through the respective engaging holes and the respective engaging pawls.

15 Claims, 18 Drawing Sheets

102
120
121
145
114A
146
141
136
114
142
106
105
103

STAMP UNIT WHOSE PRINT FACE PORTION IS FORMED OF A HEAT SENSITIVE STENCIL PAPER

BACKGROUND OF THE INVENTION

1. Field of the Invention

This invention relates to a stamp unit, and particularly to a stamp unit whose print face portion is formed of a heat sensitive stencil paper in place of rubber.

2. Description of the Related Art

There has been conventionally utilized various kinds of stamps each of which serves to print a company name, an address or other character arrays on the surface of a sheet and has a print face portion formed of rubber.

Usually, this type of stamp is individually made to order. Hence, they are expensive and a user must wait for a long time to receive them from an order.

On the other hand, a heat sensitive stencil paper has been conventionally used for printing in which a desired pattern can be perforated by irradiation of infrared rays or a thermal head, and ink is transmitted through a perforation array to print various kinds of patterns of character arrays, figures, marks or the like.

In U.S. Pat. No. 5,285,725, the applicant of the present application proposed a stencil plate that mainly contains a heat sensitive stencil paper as described above and an impregnation member impregnated with ink. The stencil plate is suitable to prepare a stamp in place of the conventional stamp having the print face portion formed of rubber as described above.

The stencil plate is formed as follows. An impregnation member impregnated with ink and a frame member surrounding the impregnation member are adhesively attached to a synthetic resin film, and a heat sensitive stencil paper is adhesively attached onto the surfaces of the impregnation member and the frame member.

When the stencil plate as described above is applied to a stamp, the stencil plate is adhesively attached to the lower surface of the base portion of a stamp member having a grip portion through a cushion member, and a desired pattern of a character array or the like is perforated on a heat sensitive paper by irradiation of infrared rays or a thermal head. With this construction, a stamp that comprises a stamp member and a stencil plate and can print the desired character-array pattern or the like on sheets over many times can be obtained.

In a stamp to which the heat sensitive stencil paper as described above is applied, the heat sensitive stencil paper located on the lower surface of the impregnation member constitutes the print face portion. A frame having a width is provided around the print face portion, and thus, it may suffer from a number of problems. In particular, it is difficult to locate the print face portion at a desired position on the surface of a sheet for a printing operation; the ink leaks from the print face portion due to its weight when the stamp is left erect during periods of nonuse; and the print face portion is damaged or dust collects on the print face portion because no protection member for protecting the print face portion is provided, and print performance is liable to be reduced.

Further, the above stamp is designed so that the heat sensitive stencil plate is provided on the lower surface of a base portion of a stamp member having a grip member through a cushion member. Therefore, when an impregnation member fixed to the stamp member lacks ink, a new stamp unit must be used. Accordingly, each stamp unit is required to be disposable, which increases costs. Further, if the stamp unit is designed to exchange a frame portion to which a new impregnation member impregnated with ink adheres, it is difficult to secure a portion to be detached for exchange. Therefore, for exchange, not only the hands are stained, but also peripheral portions are also stained. In addition, there is a possibility that ink is excessively supplied when the stamp is used.

SUMMARY OF THE INVENTION

An object of this invention is to provide a stamp unit using a heat sensitive stencil paper that is easily positioned for a printing operation and from which no ink leaks at its nonuse time.

Another object of this invention is to provide a stamp unit that is continuously usable at low cost by partially exchanging the stamp unit to make a new impregnation member.

A further object of this invention is to provide a stamp unit that can be partially exchanged.

The stamp unit of the present invention comprises a grip portion that is grasped by a hand; a stamp portion fixed to the grip portion that includes a base member, an ink member fixed to the lower surface of the base member and a heat sensitive stencil paper that covers at least the lower surface of the ink member and constitutes a print face portion, and an outer-periphery holding member that surrounds the outer peripheral portion of the heat sensitive stencil paper extending toward the outer peripheral side of the base member; a skirt member that surrounds the outer peripheral side of the stamp portion and is upwardly and downwardly moved; and a protection cap that covers the print face portion of the stamp portion and is freely detachably mounted on the stamp portion.

The stamp unit may further include plural engaging holes formed at the lower portion of the grip member and plural engaging pawls that are provided at the upper portion of the stamp member and are elastically engaged with the respective engaging holes, wherein the grip member and the stamp member are mutually detachably mounted to each other through the respective engaging holes and the respective engaging pawls.

The stamp unit may still further comprise an insertion hole through which each of the engaging holes is inserted from the upper side and is freely upwardly and downwardly movable while surrounding the outer periphery of the stamp member, and an engagement releasing piece that is formed at the end edge of the insertion hole and abuts against each of the engaging pawls when the grip member is pulled up while the skirt member is fixed, thereby elastically deforming each of the engaging pawls so that engagement between each of the engaging holes and each of the engaging pawls is released.

The stamp unit according to this invention preferably comprises an engaging plate linked to the lower portion of the grip member, and a pair of engaging pawls that are formed at the upper portion of the stamp member and are elastically engaged with the end edge of the engaging plate, wherein the grip member and the stamp member are mutually detachably mounted to each other through the engaging plate and each of the engaging pawls.

The stamp unit according to this invention may still further comprise an engagement releasing piece that is formed in the skirt member and abuts against each of the engaging pawls when the grip member is pulled up, thereby elastically deforming each of the engaging pawls so that engagement between the engaging plate and each of the engaging pawls is released.

In the stamp unit according to the present invention, a number of pores are beforehand formed in a desired pattern on the heat sensitive stencil paper constituting the print face portion, and a print face portion is pressed against the surface of a sheet while the grip member is grasped, whereby ink in the ink member oozes through the pores, and thus, the desired pattern can be printed on the surface of the sheet.

Here, the skirt member that is freely upwardly and downwardly movable so as to surround the outer peripheral side of the stamp portion is provided. Therefore, in a print operation, the print face portion is positioned to a desired print position in a state where the skirt member is downwardly moved, and the grip portion is pressed downwardly, whereby the skirt member is upwardly moved relative to the stamp portion, and thus, the print is allowed to be performed on the surface of the sheet by the print face portion. Further, during periods of nonuse, the skirt member is downwardly moved to support the stamp unit, and it is effectively usable as a leg for protecting the print face portion.

According to the stamp unit of this invention, the stamp portion is provided with the outer-periphery holding member that surrounds the outer peripheral portion of the heat sensitive stencil paper extending to the outer peripheral side of the base member at a more inside portion than the skirt member so that the outer peripheral portion of the heat sensitive stencil paper extending to the outer peripheral side of the base member can be prevented from being damaged by the skirt member.

The protection cap covers the print face portion of the stamp portion and is freely detachably mounted on the stamp portion. Therefore, damage of the print face portion and dust-attachment to the print face portion at its nonuse time can be prevented by the protection cap, and a portion that should not be printed can be prevented from being printed due to an erroneous operation.

The engaging pawls provided at the upper portion of the stamp member may be elastically deformed and engaged with the engaging holes formed at the lower portion of the grip member, whereby the stamp member is coupled to the grip member and unified into one body. Conversely, the same elastic deformation of the engaging pawls also causes the engaging pawls to be detached from the engaging holes, and the stamp member is separated from the grip member. Therefore, the attachment and detachment of the stamp member can be easily performed.

Further, according to the stamp unit of this invention, the engaging holes formed at the lower portion of the grip member are inserted into the insertion hole formed in the skirt member that surrounds the outer periphery of the stamp member. When the grip member is pulled up while the skirt member is fixed in a state where the engaging pawls of the stamp member are engaged with the engaging holes inside of the skirt member, the engagement release piece formed at the end edge of the insertion hole abuts against each of the engaging pawls to elastically deform each engaging pawl, whereby the engagement between each engaging hole and each engaging pawl is released, and the stamp member is separated from the grip member. Accordingly, the detachment of the stamp member can be easily performed.

The engaging pawls provided at the upper portion of the stamp member may be elastically deformed and engaged with the engaging plate formed at the lower portion of the grip member, whereby the stamp member is coupled to the grip member and unified into one body. Conversely, the same elastic deformation of the engaging pawls also causes the engaging pawls to be detached from the engaging plate, and the stamp member is separated from the grip member. Therefore, the attachment and detachment of the stamp member can be easily performed.

Further, according to the stamp unit of this invention, when the grip member that is elastically linked through the compression spring to the skirt member surrounding the outer periphery of the stamp member is pulled up while the skirt member is fixed in a state where the engaging pawls of the stamp member are engaged with the engaging plate linked to the lower portion of the grip member inside of the skirt member, the engagement release piece formed in the skirt member abuts against each of the engaging pawls to elastically deform each engaging pawl, whereby the engagement between the engaging plate and each engaging pawl is released, and the stamp member is separated from the grip member. Accordingly, the detachment of the stamp member can be easily performed.

BRIEF DESCRIPTION OF THE DRAWINGS

Other objects and advantages of the invention will become apparent from the following detailed description of preferred embodiments when taken in conjunction with the accompanying drawings, in which.

DETAILED DESCRIPTION OF PREFERRED EMBODIMENTS

Figure 1:
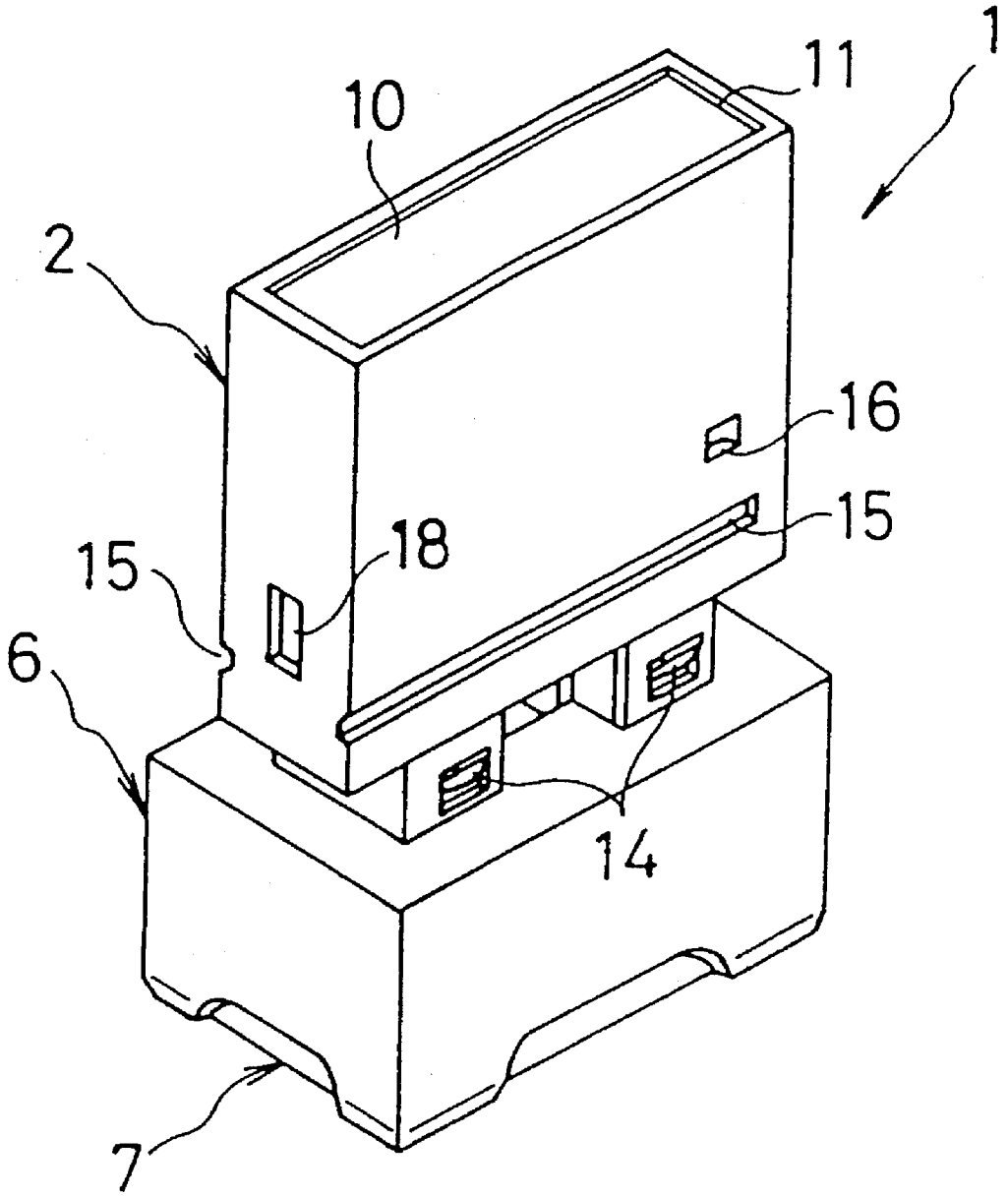
FIG. 1 is a perspective view of a stamp unit according to a first embodiment of this invention.

A first embodiment according to this invention will be described with reference to FIGS. 1 through 10.

As shown in FIGS. 1 to 4, a stamp unit 1 includes a grip portion 2 that is grasped by a hand, a stamp member 3 that is fixedly linked to the grip portion 2, a skirt member 6 covering the outer peripheral side of the stamp member 3, and a protection cap 7 that is freely detachably mounted on the stamp member 3.

The grip portion 2 comprises a hollow member having a rectangular parallelepiped shape, which is formed of metal or synthetic resin material and whose lower end is opened. A recess portion 11 onto which a label 10 is attached is formed at the top portion of the grip portion 2, and a pair of engaging pawls 14 that project downwardly is provided at each of the lower end portions of the front wall 12 and the rear wall 13 of the grip portion 2. A guide groove 15 is formed at each of the lower portions of the front wall 12 and the rear wall of the grip portion 2 in order to maintain the grip portion at a predetermined position when the dot pattern is perforated. An engaging recess 16 is formed on the front wall 12, and an engaging hole 18 is formed on the left side wall 17. A spring support portion 20 is formed at the central portion of the lower surface of the upper wall 19 inside of the grip portion 2.

The stamp member 3 comprises a stamp member body 4 and an outer-periphery holding member 5 into which the stamp body 4 is fixedly inserted from the lower side, and which covers about ⅔ of the upper portion at the outer peripheral side of the stamp member body 4 and is engaged with the four engaging pawls 14 of the grip portion 2 so that it is fixed to the grip portion 2.

The stamp member body 4 comprises a base member 26 of synthetic resin, which is designed in a rectangular parallelepiped shape having a hollow body and provided with a shallow recess portion 25 at the lower surface side thereof, an impregnation member 27 (corresponding to an ink member) mounted on the recess portion 25 and impregnated with oil ink, and a heat sensitive stencil paper 28 that covers the lower surface of the impregnation member 27 and the outer peripheral side of the base member 26 and is adhesively attached to the outer peripheral surface of the base member 26 with adhesive agent 29. The impregnation member 27 may be adhesively attached to the recess portion 25 of the base member 26 with adhesive agent or the like.

The base member 26 is formed of a synthetic resin material having an excellent oil-proof property (for example, vinyl chloride, polypropylene, polyethylene, polyacetal, polyethylene terephthalate or the like) or metal material as it is contacted with the oil ink. The impregnation member 27 is mounted on the recess portion 25 of the base member 26, thereby preventing positional deviation of the impregnation member 27 and also preventing flow-out of ink from the impregnation member 27.

The impregnation member 27 comprises an elastic foaming that is formed of synthetic material (for example, polyethylene, polypropylene, polyethylene terephthalate, polyurethane, acrylonitrile-butadiene rubber), or non-woven fabric. The impregnation member 27 is impregnated with ink in a saturated state, and by pressing the impregnation member 27, the ink oozes out from the impregnation member.

Figure 6:
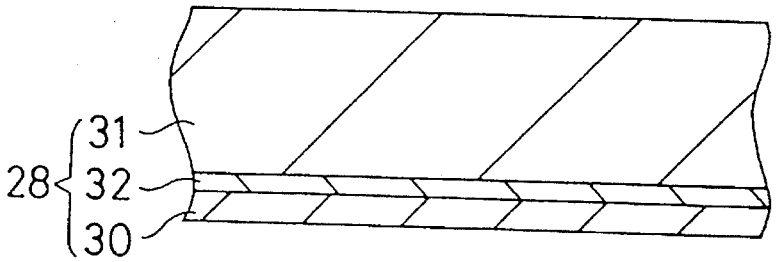
FIG. 6 is an enlarged cross-sectional view of a heat sensitive stencil paper of the stamp unit according to the first embodiment.

As shown in FIG. 6, the heat sensitive stencil paper 28 comprises a thermoplastic film 30, a porous carrier 31 and an adhesive layer 32 through which the thermoplastic film 30 and the porous carrier 31 are adhesively attached to each other. The thermoplastic film 30 is formed of a thermoplastic synthetic resin film (for example, polyethylene terephthalate, polypropylene, vinylidene chloride-vinyl chloride copolymer or the like) having a thickness of about 1 to 4 μm, preferably about 2 μm.

If the thickness is less than 1 μm, the manufacturing cost is increased, and its strength is reduced, resulting in poor practical use. On the other hand, if the thickness is above 4 μm, it is too thick to perforate the film with a general thermal head having a rated power of about 50 $mJ/mm^2$.

The porous carrier 31 is formed of a porous thin sheet of paper made primarily of a natural fiber (such as Manila hemp, kozo or mitsumata), a synthetic fiber (such as polyethylene terephthalate, polyvinyl alcohol or polyacrylonitrile), or a semi-synthetic fiber (such as rayon).

Figure 5:
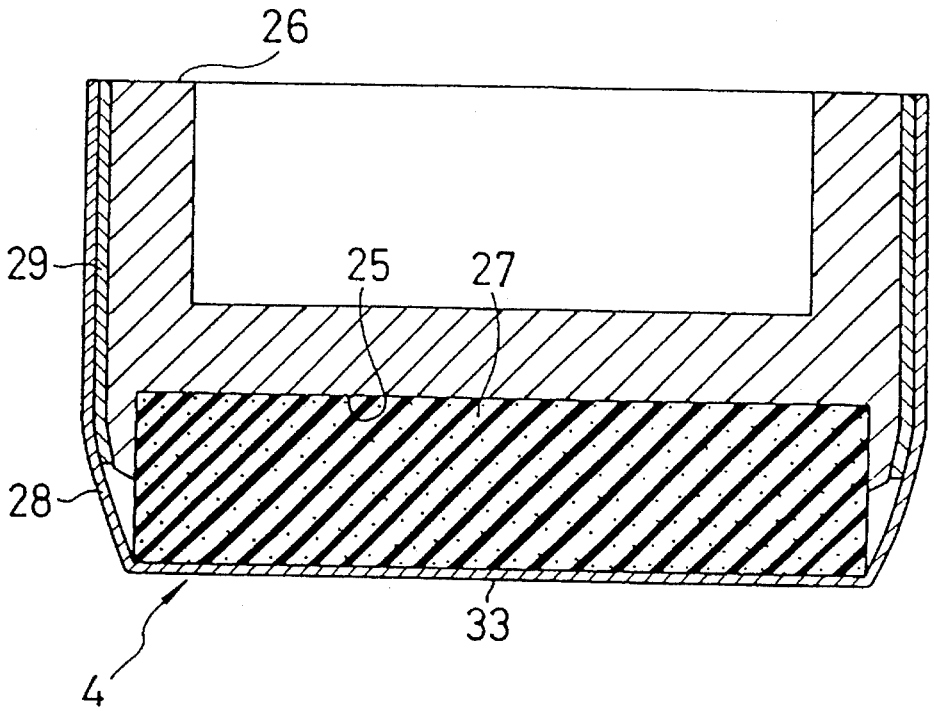
FIG. 5 is an enlarged longitudinal-sectional front view of a stamp unit body of the stamp unit according to the first embodiment.
Figure 7:
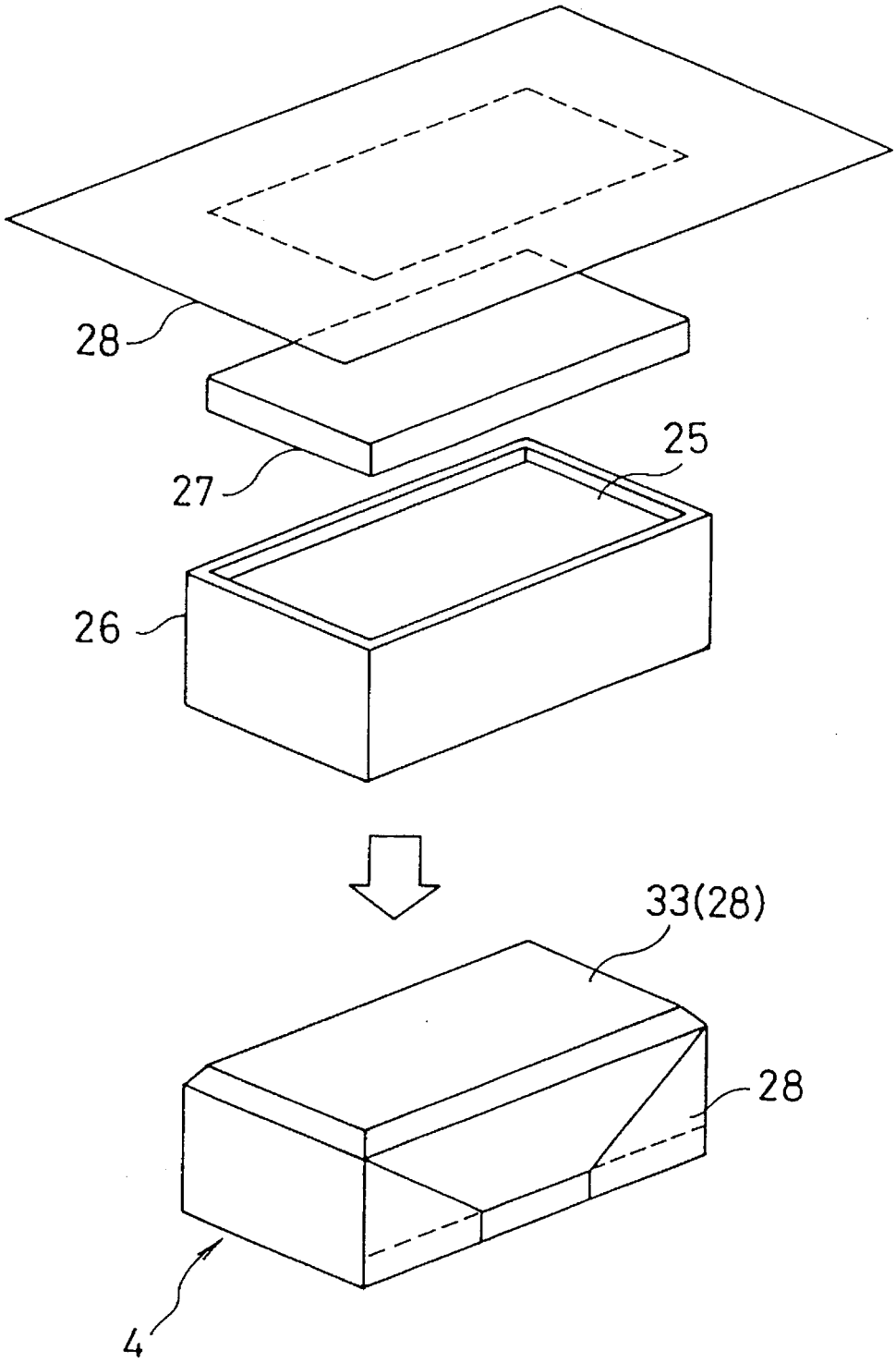
FIG. 7 is a perspective view showing a manufacturing method of the stamp unit body according to the first embodiment.

As shown in FIGS. 5 and 7, in a state where the base member 26 is inverted, the impregnation member 27 is mounted on the recess portion 25 and then impregnated with ink. Thereafter, the impregnation member 27 is covered with the heat sensitive stencil paper 28 from its upper side so that the porous carrier 31 faces the impregnation member 27, and the heat sensitive stencil paper 28 is closely contacted with the surface of the impregnation member 27. The outer-peripheral side portion of the heat sensitive stencil paper 28 is folded to come into close contact with the outer peripheral surface of the base member 26 and then adhesively attached thereto with an adhesive layer 29, thereby forming the stamp member body 4 shown in FIG. 7.

A portion of the heat sensitive stencil paper 28 that is closely contacted with the surface (lower surface in FIG. 5) of the impregnation member 27 serves as the print face portion 33. The outer peripheral side of the heat sensitive stencil paper 28 is contacted with the outer peripheral surface of the base member 26, and the print face portion 33 can be formed over substantially the whole area on the lower surface of the stamp member 3 so that positioning thereof can be simplified.

In order to adhesively attach the outer peripheral side portion of the heat sensitive stencil paper 28 to the outer peripheral surface of the base member 26, the adhesive layer 29 may be beforehand formed at the outer peripheral side portion of the heat sensitive stencil paper 28, the adhesive layer 29 may be beforehand formed on the outer peripheral surface of the base member 26, or both.

Figure 2:
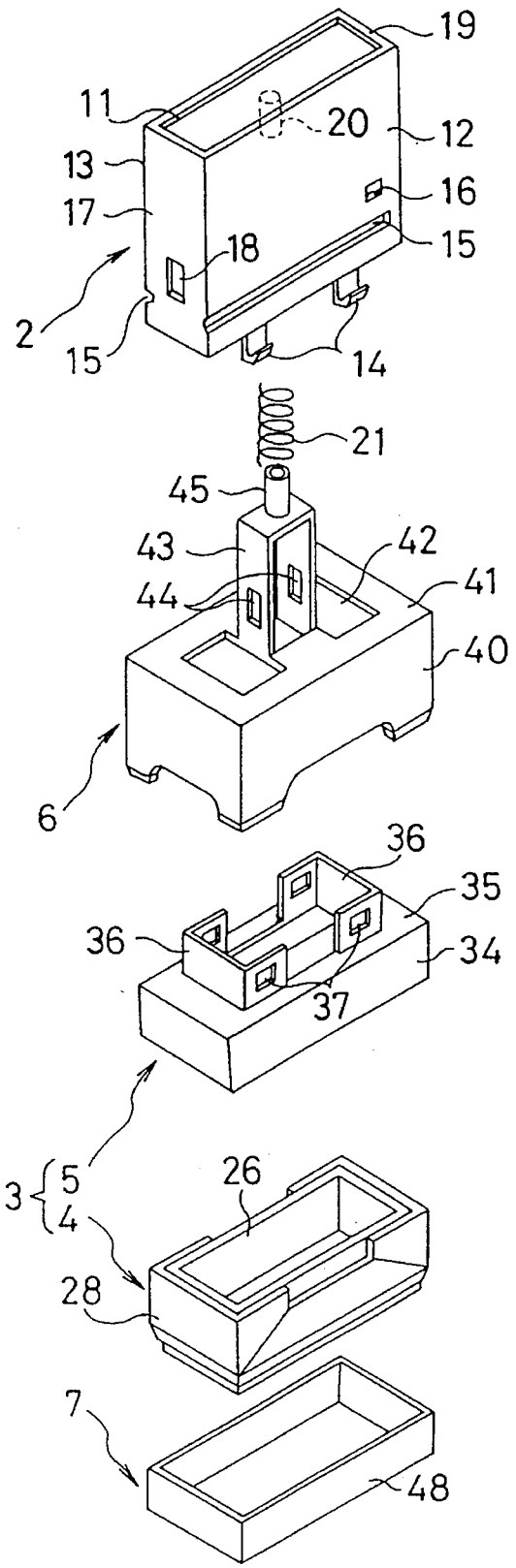
FIG. 2 is an exploded perspective view of the stamp unit according to the first embodiment.
Figure 3:
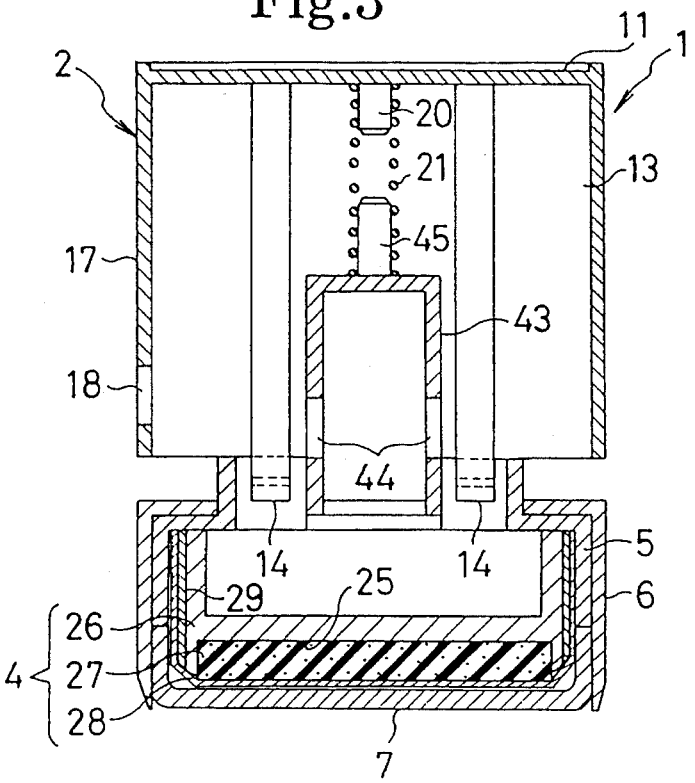
FIG. 3 is a longitudinal-sectional front view of the stamp unit according to the first embodiment.
Figure 4:
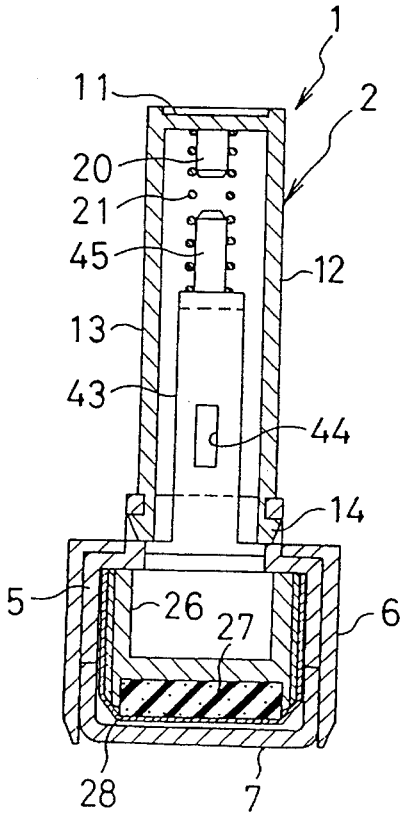
FIG. 4 is a longitudinal-sectional side view of the stamp unit according to the first embodiment.

As shown in FIGS. 2 to 4, the outer-periphery holding member 5 comprises a peripheral wall portion 34 having a rectangular section that is adhesively attached to the stamp member body 4 while the stamp member body 4 is inserted inside of the peripheral wall portion 34, an upper wall portion 35, and a pair of right and left engaging wall portions 36, which project from the upper wall portion 35 by a predetermined height. Engaging holes 37, which correspond to the four engaging pawls 14 of the grip portion 2, are formed on the pair of right and left engaging wall portions 36. The pair of right and left engaging wall portions 36 are freely slidably inserted into a pair of right and left rectangular holes 42 on the upper wall 41 of the skirt member 6. The four engaging pawls 14 are engaged with the four engaging holes 37 of the engaging wall portions 36, and the upper ends of the engaging wall portions 36 are contacted with the lower end of the grip portion 2, whereby the outer-periphery holding member 5 is fixed to the grip portion 2.

As shown in FIGS. 2 to 4, the skirt member 6 comprises an outer-peripheral wall portion 40 having a rectangular section into which the outer-peripheral wall portion 34 of the outer-periphery holding member 5 is freely slidably inserted, an upper wall portion 41, which is at the upper end of the outer peripheral wall portion 40 and located at the upper side of the upper wall portion 35 of the outer-periphery holding member 5, a portal portion 43, which projects from the central portion of the upper wall portion 41 upwardly by a predetermined height and is insertable into the grip portion 2, and a spring support portion 45, which is projectedly provided at the central portion of the upper end of the portal portion 43.

At the lower portion of the right and left wall portions of the portal portion 43, guide holes 44 are formed at front and rear side positions corresponding to the guide holes 18. Hence, a continuous hole extends through both of the wall portions.

A spring 21 urging the skirt member 6 downwardly with respect to the grip portion 2 is mounted on the spring support portion 20 of the grip portion 2 and the spring support portion 45 of the skirt member 6. The skirt member 6 is designed to be freely moved upwardly and downwardly over a first position shown in FIGS. 3 and 4, a second position shown in FIG. 9 and a third position shown in FIG. 8, and the skirt member 6 is urged toward the first position by the spring 21. The lower end portions on the four surfaces of the outer peripheral wall 40 of the skirt member 6 are partially cut out (i.e., relieved) to enable the protection cap 7 to be detached and to enable positioning of the print face portion 33. The skirt member 6 is made of a transparent material in order to easily perform the positioning of the print face portion 33.

At the first position, the upper wall portion 41 of the skirt member 6 abuts against the upper wall portion 35 of the outer-periphery holding member 5, and the lower end of the skirt member 6 projects to a position lower than the print face portion 33. At the second position, the upper wall portion 41 of the skirt member 6 is located at a position between the upper wall portion 35 of the outer-periphery holding member 5 and the lower end of the grip portion 2, and the lower end of the skirt member 6 is located at substantially the same level as the print face portion 33. At the third position, the upper wall portion 41 of the skirt member 6 abuts against the lower end of the grip portion 2, and the lower end of the skirt member 6 is located at a position higher than the print face portion 33. A stroke of the skirt member 6 from the first position to the second position is preferably set to about 5 mm.

The protection cap 7 is freely detachably disposed so as to cover the lower end side of the stamp member body 4, thereby protecting the stamp unit body, and the outer wall portion 48 thereof is designed in the same sectional shape as the outer peripheral wall 34 of the outer-periphery holding member 5. The protection cap 7 is engagedly inserted into the inner portion of the outer peripheral wall portion 40 of the skirt member 6 and supported thereby.

As shown in FIGS. 3 and 4, when the protection cap is mounted, the upper end thereof abuts against the lower end of the outer peripheral wall 34, a small gap occurs between the protection cap 7 and the print face portion 33, and the protection cap 7 is supported by a frictional force between the outer peripheral surface of the outer peripheral wall portion 48 and the inner peripheral surface of the outer peripheral wall portion 40 of the skirt member 6. Therefore, even when the grip portion 2 is downwardly pressed in the state where the protection cap 7 is mounted, the gap is maintained due to the abutment between the upper end of the protection cap 7 and the lower end of the outer peripheral wall 34, and thus, no ink is transferred to the protection cap 7.

Figure 10:
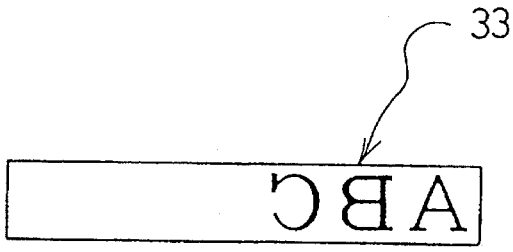
FIG. 10 is a diagram showing an example of a pattern obtained by perforating a print face portion of the stamp unit according to the first embodiment.
Figure 11:
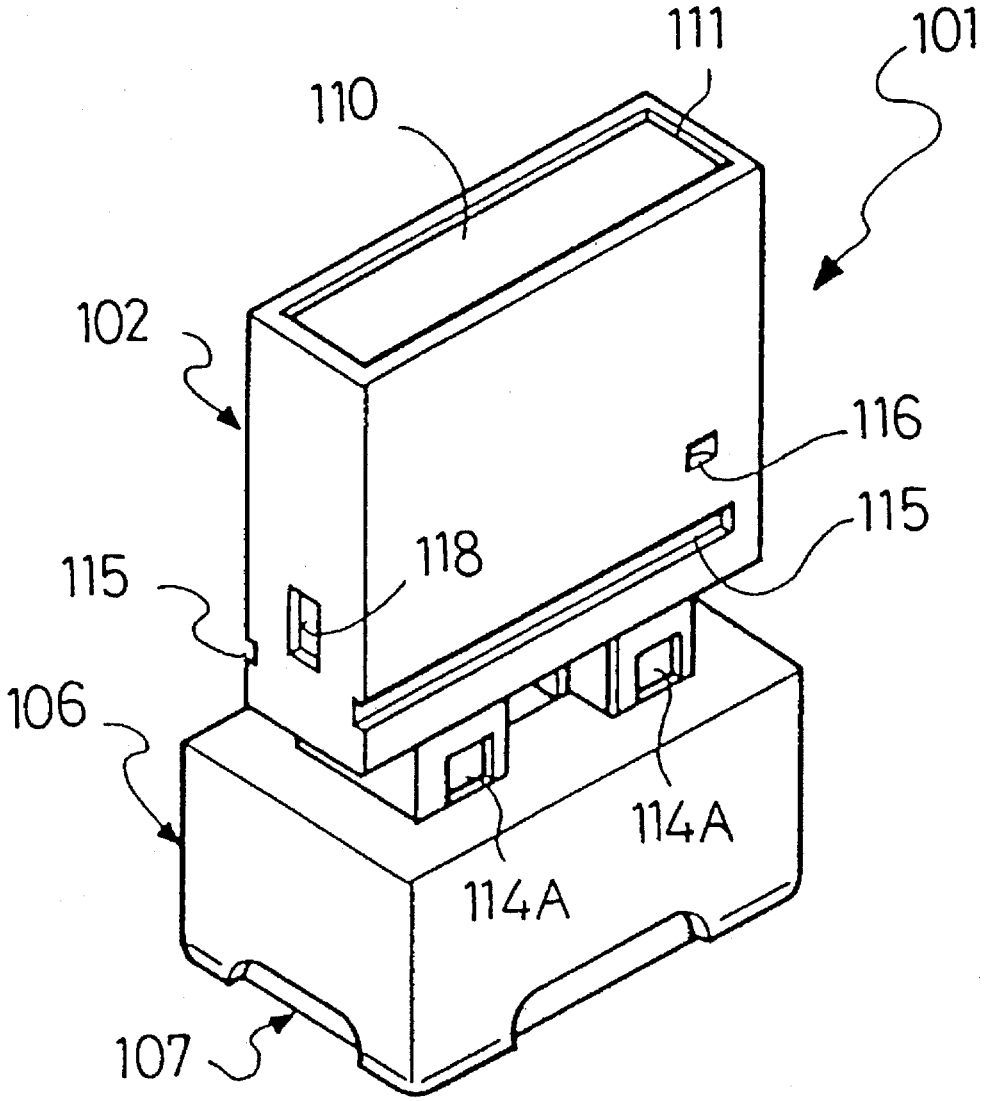
FIG. 11 is a perspective view of a stamp unit according to a second embodiment of this invention.

For example, as shown in FIG. 10, dot-pattern pores of a pattern, which is formed of a character array of a mirror image of "ABC" and rectangular frame surrounding the outer side of the character array, are formed by a thermal head of a thermal printer (not shown) on the print face portion, thereby designing a stamp member capable of printing a character array of a mirror image of the pattern of FIG. 10, "ABC" and the rectangular frame. Accordingly, like an ordinary stamp having a print face portion formed of rubber, the pattern as described above can be printed over about 1000 times, for example. As is well known, the perforation may be performed by irradiation of infrared rays in place of the thermal head.

Figure 8:
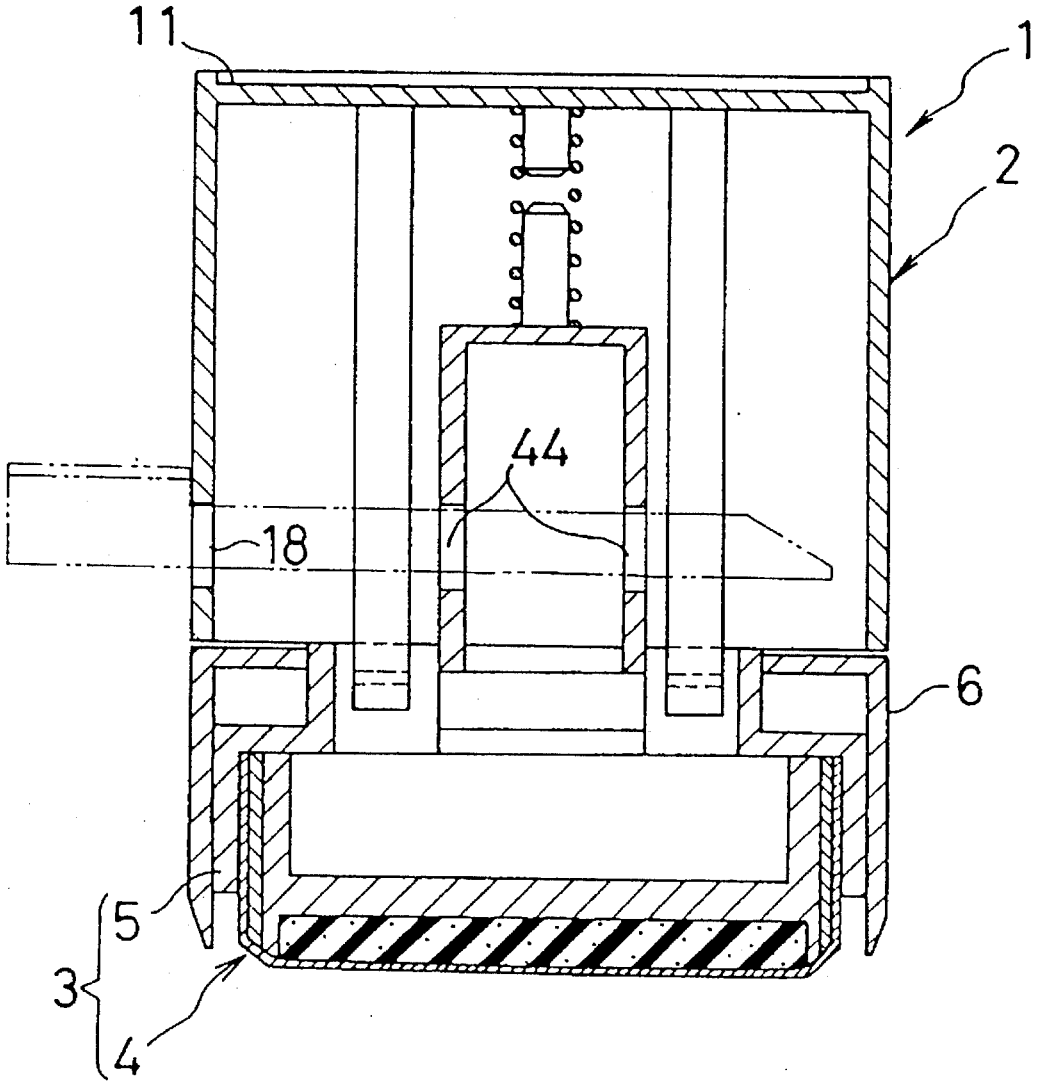
FIG. 8 is a longitudinal-sectional front view of the stamp unit when the skirt member of the first embodiment is located at the third position.
Figure 9:
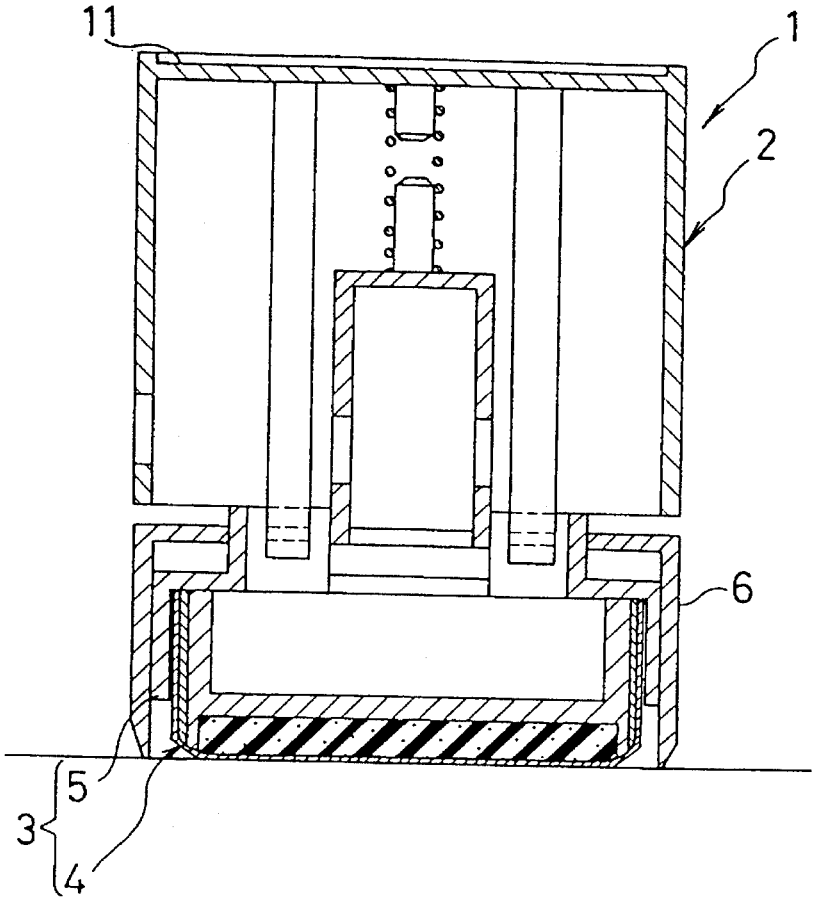
FIG. 9 is a longitudinal-sectional front view of the stamp unit when the skirt member of the first embodiment is located at the second position.

When the heat sensitive stencil paper 28 serving as the print face portion 33 is perforated, the stamp unit 1 is mounted on a perforation mount portion of a thermal perforating device (not shown), and a guide bar thereof (as shown in FIG. 8 with alternate long and two short dashes line) is inserted through guide holes 18, 44, 44 to keep the skirt member 6 at the third position so that perforation can be performed. Further, when the device is unused, the protection cap 7 is mounted, and as shown in FIGS. 3 and 4, the skirt member 6 is maintained at the first position. When a print is performed, the protection cap 7 is detached, and the skirt member 6 is maintained at the first position to position the skirt member 6 to a printing position on the surface of a sheet, thereby positioning the print face portion 33 of the stamp member 3. Thereafter, the grip portion 2 is downwardly pressed to perform the print as shown in FIG. 9.

Next, the operation of the stamp unit 1 thus constructed will be described.

Dot-pattern pores of a desired pattern are formed on the heat sensitive stencil paper 28 serving as the print face portion 33, the protection cap 7 is detached, and the print face portion 33 is positioned to a desired position on the surface of a sheet through the skirt member 6. Thereafter, when the operator grasps the grip portion 2 to press the grip portion 2 downwardly and press the print face portion 33 on the surface of the sheet, the impregnation member 27 is pressed between the base member 26 and the sheet, and the ink in the impregnation member 27 oozes out through the pores, and thus, the perforation pattern is printed on the surface of the sheet.

The skirt member 6, which is disposed to surround the outer peripheral side of the stamp member 3, is designed to be freely upwardly and downwardly moved over the first, second and third positions. The skirt member 6 thus constructed is elastically urged toward the first position so that the print face portion 33 can be perforated to form a desired pattern in a desired dot pattern when the skirt member 6 is maintained at the third position.

In the printing operation, when the skirt member 6 is maintained at the first position and set to a print position on the surface of a sheet, the print face portion 33 is positioned, and the grip portion 2 is pressed, the spring contracts and the skirt member 6 is elevated (relative to the downwardly moving print face portion) to the second position. Therefore, the print can be accurately performed at a desired position. When the press force applied to the grip portion 2 is moderated after the print, exfoliation of the sheet from the print face portion 33 is promoted due to a returning action of the skirt member 6 to the first position so that the print can be beautifully performed on even a thin sheet. In a case where the print is performed within a narrow frame on the surface of a sheet, the print can be performed while the skirt member 6 is held by hand at the second or third position.

When the device is unused, the skirt member 6 is held at the first position by the urging force of the spring 21, the whole stamp unit 1 is supported by an under surface of the skirt member 6, and the print face portion 33 can be protected because the print face portion 33 is located inside the skirt member 6.

Further, the stamp member 3 is provided with the heat sensitive stencil paper, which fixedly covers the surface portion of the impregnation member 27, and with the outer-periphery holding member 5, which surrounds the outer peripheral portion of the heat sensitive stencil paper 28 extending to the outer peripheral side of the base member 26 inside of the skirt member 6. Therefore, the outer peripheral portion of the heat sensitive stencil paper 28 extending to the outer peripheral side of the base member 26 can be prevented from being damaged by the skirt member 6, and the ink can be prevented from flowing out to the outside from the impregnation member 27.

The print face portion 33 can be fitted to the predetermined print position by moving the stamp unit 1, confirming the print position and the position of the print face portion 33 by viewing through the cut portion on the upper surface of the skirt member 6.

The protection cap 7 prevents damage of the print face portion 33 and attachment of dust to the print face portion 33 when the device is unused. In addition, the protection cap 7 prevents printing at a position where print is not desired due to an erroneous operation.

In the above embodiment, a pattern to be formed by perforating the heat sensitive stencil paper 28 of the print face portion 33 is of course not limited to one as described above. Various patterns such as various character arrays, figures, marks, shapes, etc. may be formed in the dot pattern pores for printing.

The grip portion 2 and the stamp portion 3 may be designed to be low in height, and the grip portion 2 and the stamp member body 4 may be unified. Further, the skirt member 6 may be designed to be freely upwardly and downwardly movable relative to the stamp member body 4.

The grip portion 2 is not necessarily provided above the stamp member body 4, but may be provided at a side thereof.

When the print face portion 33 is designed, for example, in a rectangular shape, the function required of the skirt member 6 can be obtained if the skirt member 6 is designed to have leg-shaped portions on at least four corners thereof that contact the printing surface, with relieved portions interposed between the leg-shaped portions.

The flat shape of the print face portion 33 of the stamp unit 1 is not limited to the rectangular shape, but may be an elliptical shape, a circular shape, a square shape, a triangular shape, a polygonal shape or other shapes.

Various colors of the oil ink to be impregnated in the impregnation member 27 may be used such as blue, black, red, or other colors. In order to indicate the color of the ink on the label 10, a sheet piece, which is actually printed by the stamp unit 1, is attached onto the recess portion 11 formed at the upper end of the grip portion 2.

In place of the impregnation member 27, an ink member having a high viscosity lump of ink may be used. In this case, the ink member is mounted on the recess portion 25 and collected in the same shape as the impregnation member 27.

A second embodiment according to this invention will be described hereunder with reference to FIGS. 11 through 21.

As shown in FIGS. 11 to 14, a stamp unit 101 includes a grip portion 102 that is grasped by a hand, a stamp member 103 that is fixedly linked to the grip portion 102, a skirt member 106 covering the outer peripheral side of the stamp member 103, and a protection cap 107 that is freely detachably mounted on the stamp member 103.

The grip portion 102 comprises a hollow member having a rectangular parallelepiped shape, which is formed of metal or synthetic resin material and whose lower end is opened.

A recess portion 111 onto which a label 110 is attached is formed at the top portion of the grip portion 102, and a pair of foot portions 114 that project downwardly are provided at each of the lower end portions of the front wall 112 and the rear wall 113 of the grip portion 102. A guide groove 115 is formed at each of the lower portions of the front wall 112, and the rear wall of the grip portion 102. An engaging recess 116 is formed on the front wall 112, and an engaging hole 118 is formed on the left side wall 117. A spring support portion 120 is formed at the central portion of the lower surface of the upper wall 119 inside of the grip portion 102.

The stamp member 103 comprises a stamp member body 104, and an outer-periphery holding member 105 into which the stamp member body 104 is fixedly inserted covering about ⅔ of the upper portion at the outer peripheral side of the stamp member body 104 and engaging the four engaging foot portions 114 of the grip portion 102 so that it is fixed to the grip portion 102.

The stamp member body 104 comprises a base member 126 of synthetic resin, which is designed in a rectangular parallelepiped shape having a hollow body and provided with a shallow recess portion 125 at the lower surface side thereof, an impregnation member 127 (corresponding to an ink member) mounted on the recess portion 125 and impregnated with oil ink, and a heat sensitive stencil paper 128 that covers the lower surface of the impregnation member 127 and the outer peripheral side of the base member 126 and is adhesively attached to the outer peripheral surface of the base member 126 with adhesive agent 129. The impregnation member 127 may be adhesively attached to the recess portion 125 of the base member 126 with adhesive agent or the like.

The base member 126 is formed of a synthetic resin material having an excellent oil-proof property (for example, vinyl chloride, polypropylene, polyethylene, polyacetal, polyethylene terephthalate or the like) or metal material as it is contacted with the oil ink. The impregnation member 127 is mounted on the recess portion 102 of the base member 126, thereby preventing positional deviation of the impregnation member 127 and also preventing flow-out of ink from the impregnation member 127.

The impregnation member 127 comprises an elastic foaming member which is formed of synthetic material, (for example, polyethylene, polypropylene, polyethylene terephthalate, polyurethane, acrylonitrile-butadiene rubber), or non-woven fabric. The impregnation member 127 is impregnated with ink in a saturated state, and by pressing the impregnation member 127, the ink oozes out from the impregnation member.

Figure 16:
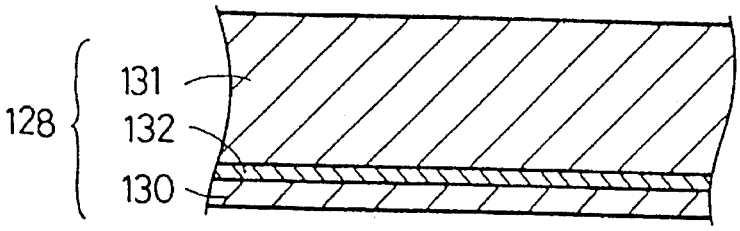
FIG. 16 is an enlarged sectional view of a heat sensitive stencil paper of the stamp unit according to the second embodiment.

As shown in FIG. 16, the heat sensitive stencil paper 128 comprises a thermoplastic film 130, a porous carrier 131 and an adhesive layer 132 through which the thermoplastic film 130 and the porous carrier 131 are adhesively attached to each other. The thermoplastic film 130 is formed of a thermoplastic synthetic resin film (for example, polyethylene terephthalate, polypropylene, vinylidene chloride-vinyl chloride copolymer or the like) having a thickness of about 1 to 4 μm, preferably about 2 μm.

If the thickness is less than 1 μm, manufacturing cost is increased, and its strength is reduced, resulting in poor practical use. On the other hand, if the thickness is above 4 μm, it is too thick to perforate the film with a general thermal head having a rated power of about 50 $mJ/mm^2$.

The porous carrier 131 is formed of a porous thin sheet of paper made primarily of a natural fiber (such as Manila hemp, kozo or mitsumata), a synthetic fiber (such as polyethylene terephthalate, polyvinyl alcohol or polyacrylonitrile), or a semi-synthetic fiber (such as rayon).

Figure 15:
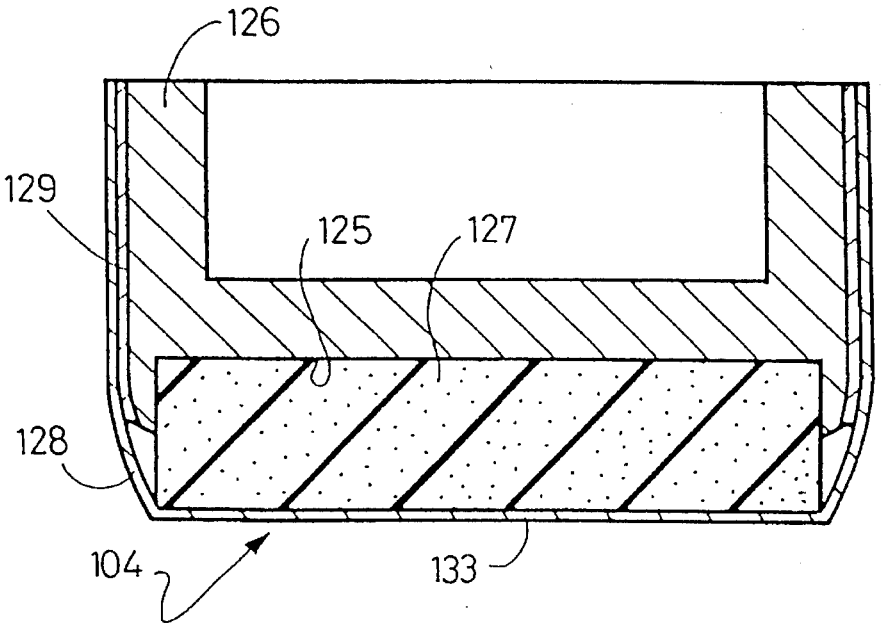
FIG. 15 is an enlarged longitudinal-sectional view of a stamp member body of the stamp unit according to the second embodiment.
Figure 17:
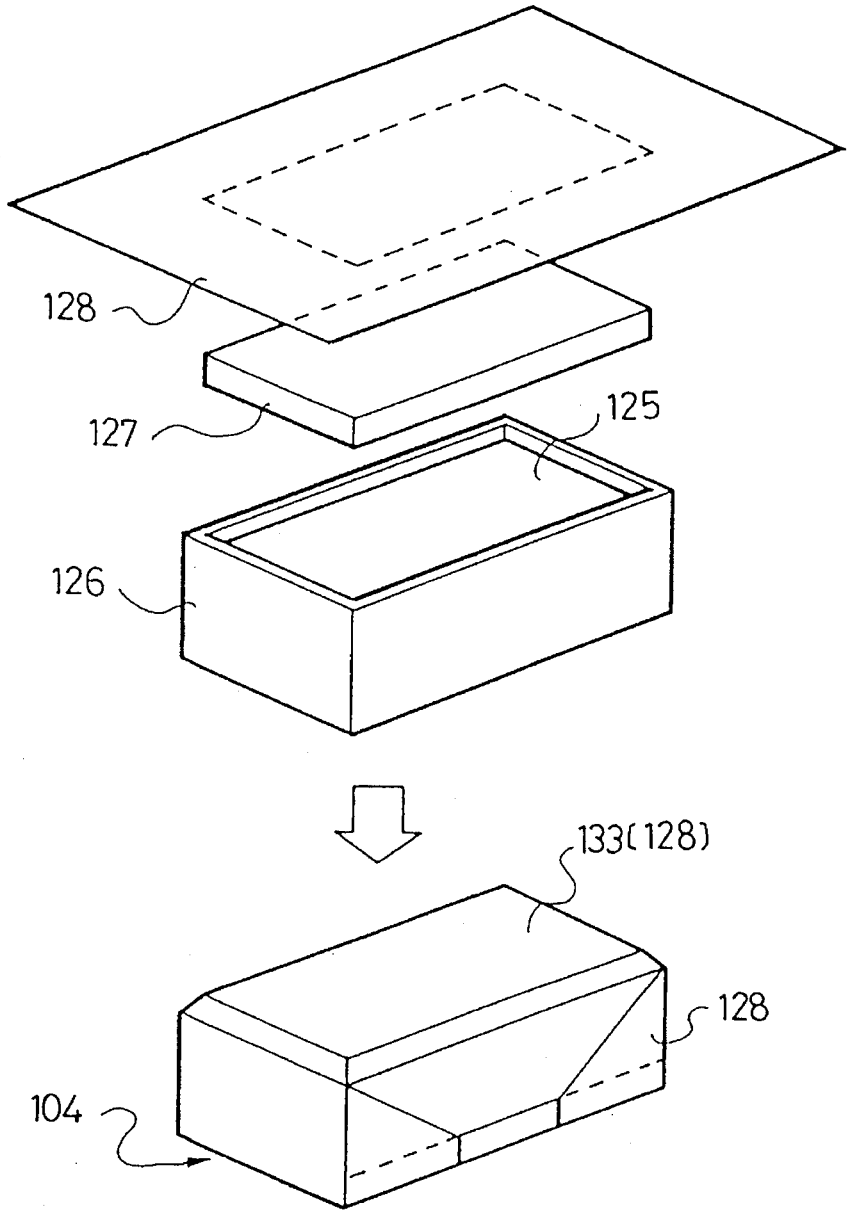
FIG. 17 is a perspective view showing a manufacturing method of the stamp member body according to the second embodiment.

As shown in FIGS. 15 and 17, in a state where the base member 126 is inverted, the impregnation member 127 is mounted on the recess portion 125 and then impregnated with ink. Thereafter, the impregnation member 127 is covered with the heat sensitive stencil paper 128 from its upper side so that the porous carrier 131 faces the impregnation member 127, and the heat sensitive stencil paper 128 is closely contacted with the surface of the impregnation member 127. The outer-peripheral side portion of the heat sensitive stencil paper 128 is folded to come into close contact with the outer peripheral surface of the base member 126 and then adhesively attached thereto with an adhesive layer 129, thereby forming the stamp member body 104 shown in FIG. 17.

A portion of the heat sensitive stencil paper 128 that is closely contacted with the surface (lower surface in FIG. 15) of the impregnation member 127 serves as the print face portion 133. The outer peripheral side of the heat sensitive stencil paper 128 is contacted with the outer peripheral surface of the base member 126, and the print face portion 133 can be formed over substantially the whole area on the lower surface of the stamp member 103 so that positioning thereof can be simplified.

In order to adhesively attach the outer peripheral side portion of the heat sensitive stencil paper 128 to the outer peripheral surface of the base member 126, the adhesive layer 129 may be beforehand formed at the outer peripheral side portion of the heat sensitive stencil paper 128, the adhesive layer 129 may be beforehand formed on the outer peripheral surface of the base member 126, or both.

Figure 12:
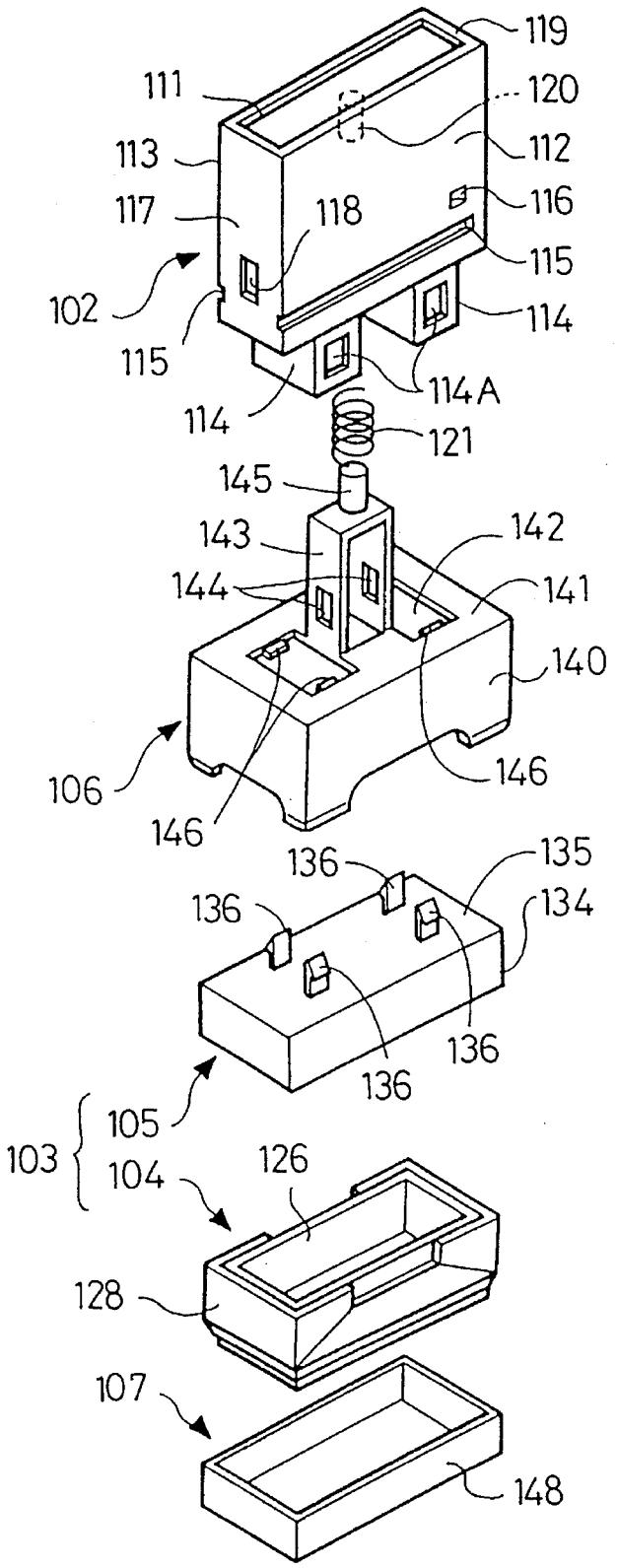
FIG. 12 is an exploded perspective view of the stamp unit according to the second embodiment.
Figure 13:
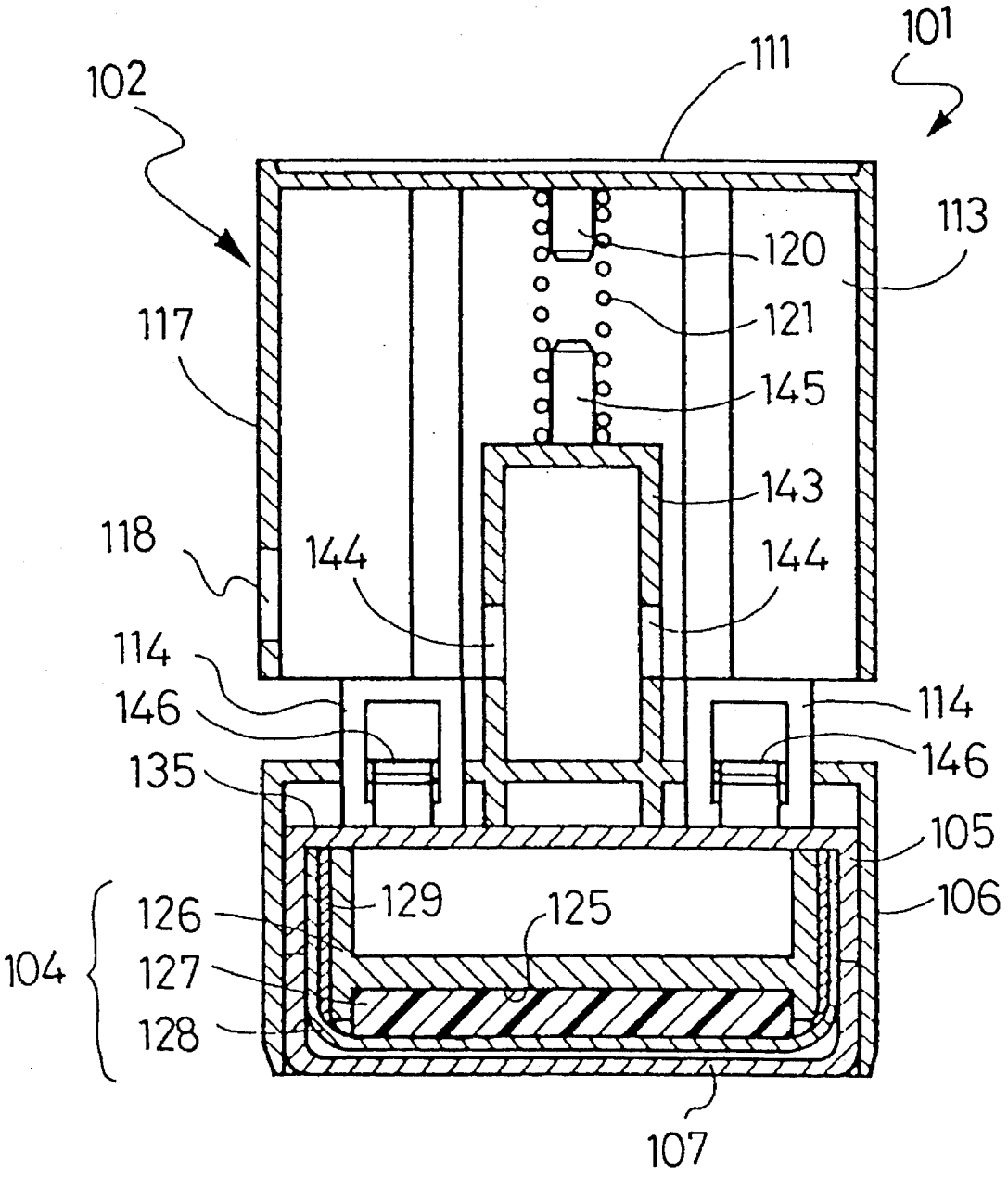
FIG. 13 is a longitudinal-sectional front view of the stamp unit according to the second embodiment.
Figure 14:
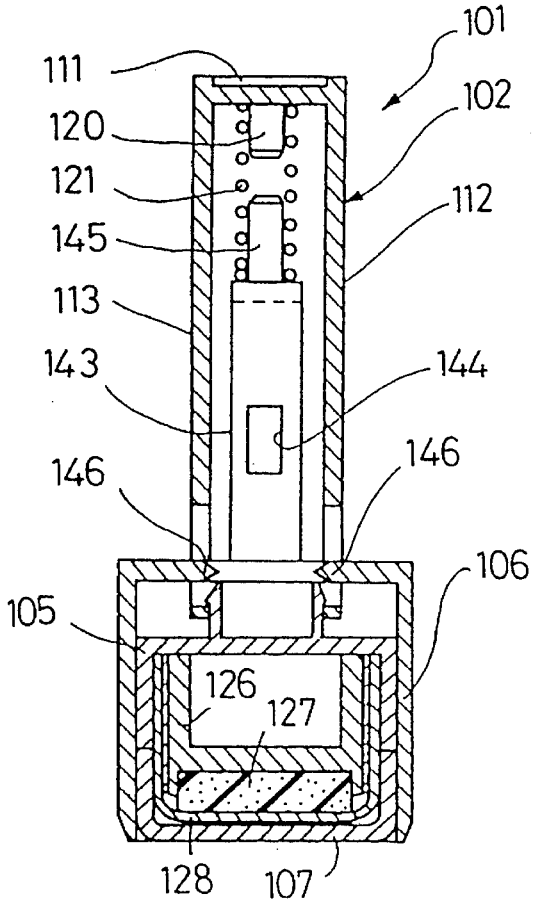
FIG. 14 is a longitudinal-sectional side view of the stamp unit according to the second embodiment.

As shown in FIGS. 12 to 14, the outer-periphery holding member 105 comprises a peripheral wall portion 134 having a rectangular section to which the stamp member body 104 is adhesively attached so as to be inserted into the inner portion of the peripheral wall portion 134, and an upper wall portion 135 provided with engaging pawls 136 corresponding to the four engaging windows 114A that are provided at the lower portion of the grip member 102. Each of the engaging pawls 136 is provided with a triangular projection at the outside thereof, and the lower slant surface of each projection is inclined upwardly.

As shown in FIGS. 12 to 14, the skirt member 106 comprises an outer-peripheral wall portion 140 having a rectangular section into which the outer-peripheral wall portion 134 of the outer-periphery holding member 105 is freely slidably inserted, an upper wall portion 141, which is at the upper end of the outer peripheral wall portion 140 and located at the upper side of the upper wall portion 135 of the outer-periphery holding member 105, a portal portion 143, which projects from the central portion of the upper wall portion 141 upwardly by a predetermined height and is insertable into the grip portion 102, and a spring support portion 145 which is projectedly provided at the central portion of the upper end of the portal portion 143.

At the lower portion of the right and left wall portions of the portal portion 143, guide holes 144 are formed at front and rear side positions corresponding to the guide holes 118. Hence, a continuous hole extends through both of the wall portions.

A pair of right and left rectangular holes 142 are formed in the upper wall portion 141 of the skirt member 106 so as to sandwich the portal portion 143 therebetween. Each of the rectangular holes 142 is provided with triangular projections 146 at the front and rear sides of the side portion thereof. In order to attach and detach the protection cap 107 and to perform positioning of the print face portion 133, the lower end portions of the central portions on the four surfaces of the outer peripheral wall 140 of the skirt member 106 are partially cut out. The skirt member 106 is made of a transparent material in order to easily perform the positioning of the print face portion 133.

The foot portions 114 of the grip member 102 are inserted into the rectangular holes 142 from the upper side so as to be vertically slidable, and the projections 146 are inserted into the engaging windows 114A of the foot portions 114. A compression spring 121 is mounted between the spring support portion 145 of the skirt member 106 and the spring support portion 120 of the grip member 102 urging the grip member 102 upwardly. The engaging pawls 136 are engaged with the lower ends of the engaging windows 114A of the foot portions 114 inside of the skirt member 106, thereby stopping the grip member 102, which is upwardly urged by the compression spring 121. The lower ends of the foot portions 114 abut against the upper wall portion 135 of the outer-periphery holding member 105, whereby the outer-periphery holding member 105 is fixed to the grip member 102.

Figure 18:
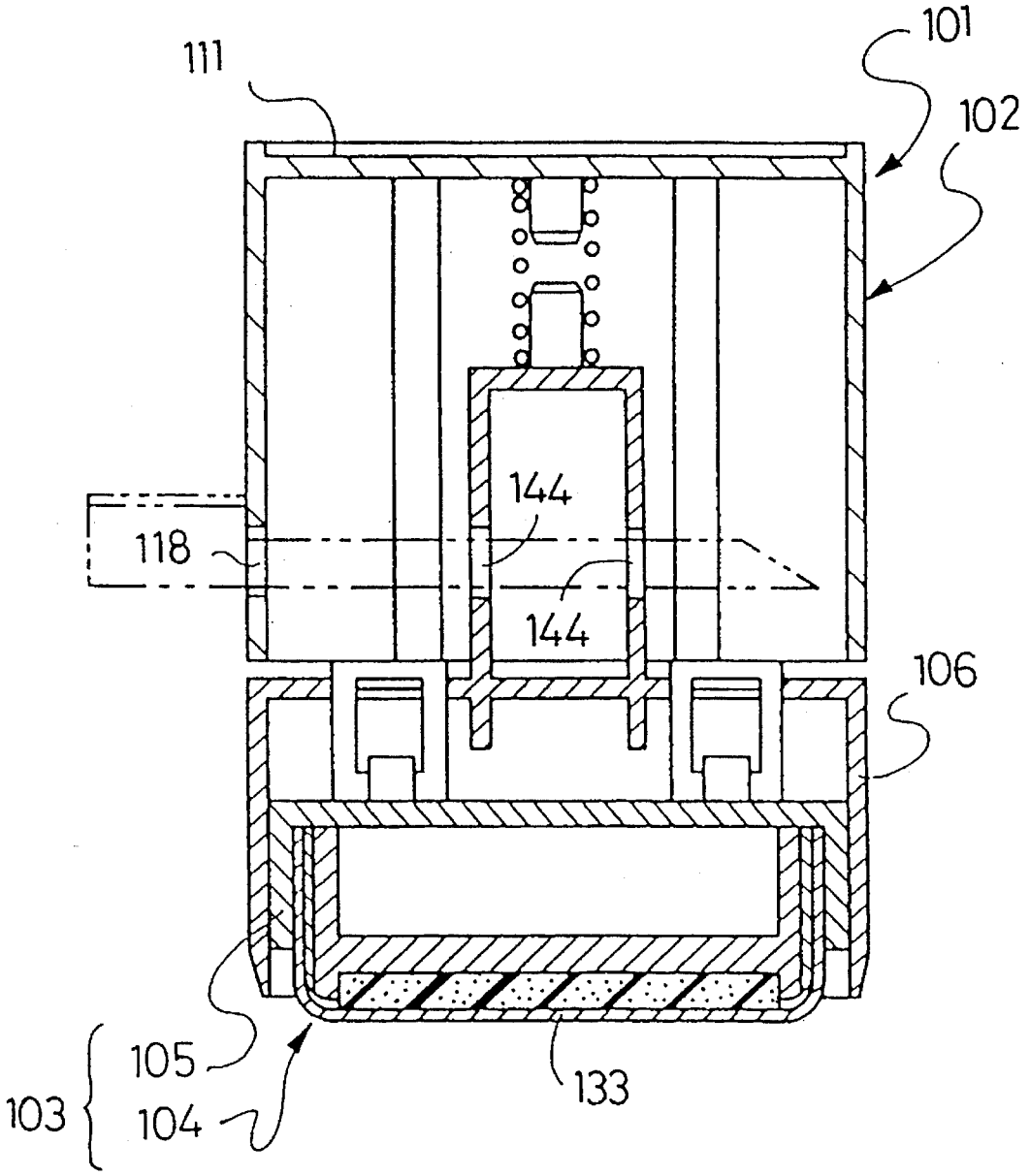
FIG. 18 is a longitudinal-sectional front view of the stamp unit when the skirt member of the second embodiment is located at the third position.
Figure 19:
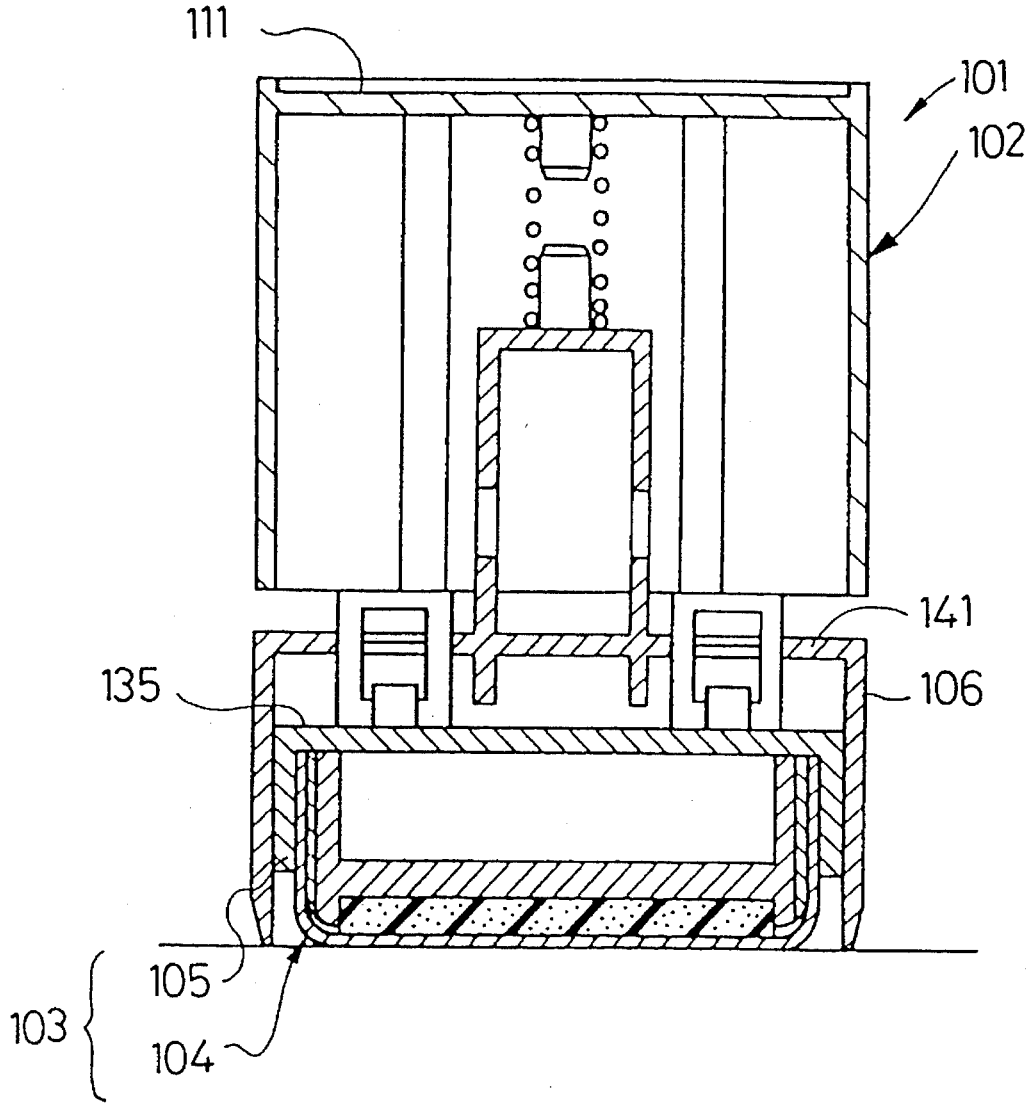
FIG. 19 is a longitudinal-sectional front view of the stamp unit when the skirt member of the second embodiment is located at the second position.

The skirt member 106 is designed to be freely movable upwardly and downwardly over the first position shown in FIGS. 13 and 14, the second position shown in FIG. 19 and the third position shown in FIG. 18, and it is kept at the first position by the spring 121 in a state where no force is applied to the grip member 102. That is, at the first position, the print face portion 133 of the stamp member 103 is located at a position higher than the lower end of the skirt member 106. At the second position, the print face portion 133 is located at the same level as the lower end of the skirt member 106. At the third position, the print face portion 133 is located at a position lower than the lower end of the skirt member 106. A stroke of the print face portion 133 from the first position to the second position is preferably set to about 5 mm.

The protection cap 107 is freely detachably disposed so as to cover the lower end side of the stamp member body 104, thereby protecting the stamp unit body, and the outer wall portion 148 thereof is designed in the same sectional shape as the outer peripheral wall 134 of the outer-periphery holding member 105. The protection cap 107 is engagedly inserted into the inner portion of the outer peripheral wall portion 140 of the skirt member 106 and supported thereby.

As shown in FIGS. 13 and 14, when the protection cap is mounted, the upper end thereof abuts against the lower end of the outer peripheral wall 134, a small gap occurs between the protection cap 107 and the print face portion 133, and the protection cap 107 is supported by a frictional force between the outer peripheral surface of the outer peripheral wall portion 148 and the inner peripheral surface of the outer peripheral wall portion 140 of the skirt member 106. Therefore, even when the grip portion 102 is downwardly pressed in the state where the protection cap 107 is mounted, the gap is maintained due to the abutment between the upper end of the protection cap 107 and the lower end of the outer peripheral wall 134, and thus, no ink is transferred to the protection cap 107.

Figure 20:
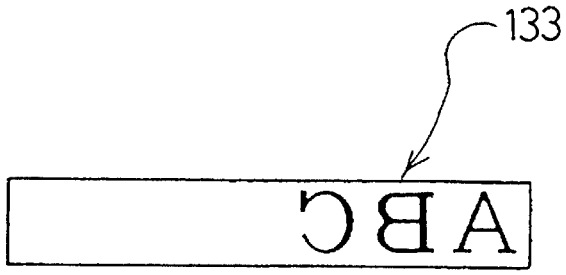
FIG. 20 is a diagram showing a pattern to be perforated on the print face portion of the stamp unit according to the second embodiment.

For example, as shown in FIG. 20, dot-pattern pores of a pattern, which is formed of a character array of a mirror image of "ABC" and rectangular frame surrounding the outer side of the character array, are formed by a thermal head of a thermal printer (not shown) on the print face portion, thereby designing a stamp member capable of printing a character array of a mirror image of the pattern of FIG. 20, "ABC" and the rectangular frame. Accordingly, like an ordinary stamp having a print face portion formed of rubber, the pattern as described above can be printed over about 1000 times, for example. As is well known, the perforation may be performed by irradiation of infrared rays in place of the thermal head.

When the heat sensitive stencil paper 128 serving as the print face portion 133 is perforated, the stamp unit 101 is mounted on a perforation mount portion of a thermal perforating device (not shown), and a guide bar thereof (not shown) is inserted through guide holes 118, 144, 144 to keep the skirt member 106 at the third position so that perforation can be performed. Further, when the device is unused, the protection cap 107 is mounted, and as shown in FIGS. 13 and 14, the skirt member 106 is maintained at the first position. When a print is performed, the protection cap 107 is detached, and the skirt member 106 is kept at the first position to position the skirt member 106 to a printing position on the surface of a sheet, thereby positioning the print face portion 133 of the stamp member 103. Thereafter, the grip portion 102 is downwardly pressed to perform the print as shown in FIG. 19.

Next, the operation of the stamp unit 101 as described above will be described.

Dot pattern pores are beforehand formed in a desired pattern on the heat sensitive stencil paper 128 serving as the print face portion 133. The protection cap is removed when a print is carried out, the stamp member 103 is maintained at the first position, and the skirt member 106 is set to the position on the surface of a sheet where the print should be carried out. At this time, the stamp unit 101 is moved, and the print position and the end portion of the print face portion 133 are visible through cut-out portion at the lower end of the skirt member 106, whereby the print face portion 133 is accurately positioned to a desired print position.

As described above, after the print face portion 133 to be printed is positioned, the grip member 102 is pressed from the upper side, and the upper wall portion 135 of the outer-periphery holding member 105 is pressed downwardly by the foot portions. As a result, the stamp member 103 is moved downwardly, and conversely, the skirt member 106 moves upwardly relative to the stamp member 103 to the second position by the spring 121 so that the print is carried out at the desired set position.

That is, when the user positions the print face portion 133 to a desired position on the surface of the sheet through the skirt member 106, then grasps the grip member 102 to press the grip member 102 downwardly and press the print face portion 133 against the surface of the sheet, the impregnation member 127 is squeezed between the base member 126 and the sheet, and the ink in the impregnation member 127 oozes from the dot pattern pores so that a perforation pattern is printed on the surface of the sheet.

After the print, the press force applied to the grip member 102 is released, and the grip member 102 is upwardly urged by the compression spring 121, and the stamp member 103 is upwardly moved and returned to the first position. Through this returning operation, the sheet is promoted to exfoliate from the sheet, and a beautiful print is printed even on a thin sheet. However, when the print is carried out within a narrow frame on the surface of a sheet, the print is carried out while the skirt member 106 is kept by hand at the second position.

At a nonuse time, the skirt member 106 is maintained at the first position by an urging force of the spring 121, and the stamp unit 101 is supported at the lower end of the skirt member 106. At this time, the print face portion is located inside of the skirt member 106, and the print face portion 133 is protected by the skirt member 106.

Figures 21A, 21B, 21C:
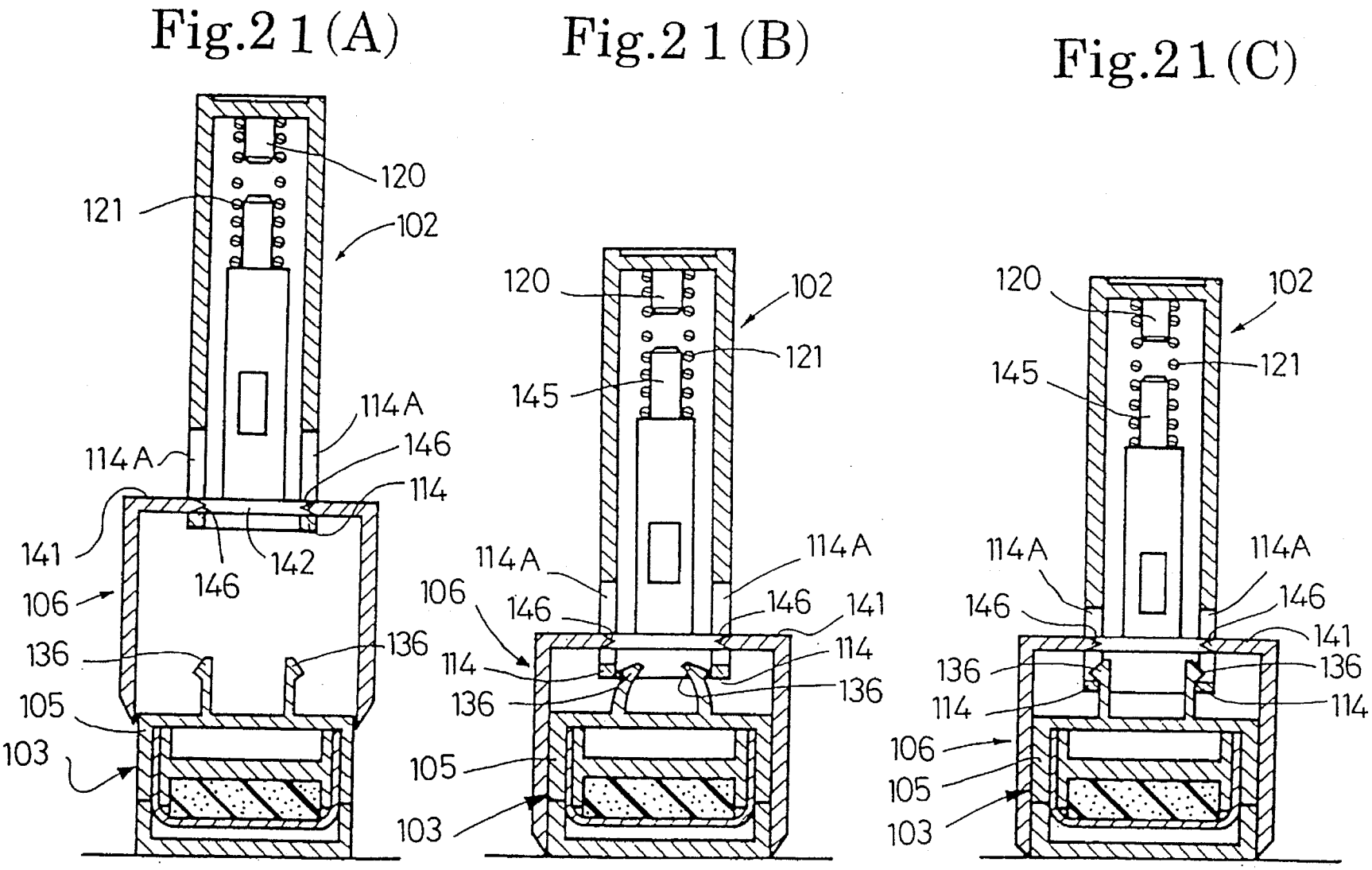
FIG. 21(A) is a sectional view showing a replacement state of the stamp member according to the second embodiment.
FIG. 21(B) is a sectional view showing a replacement state of the stamp member according to the second embodiment.
FIG. 21(C) is a sectional view showing a replacement state of the stamp member according to the second embodiment.
Figure 22:
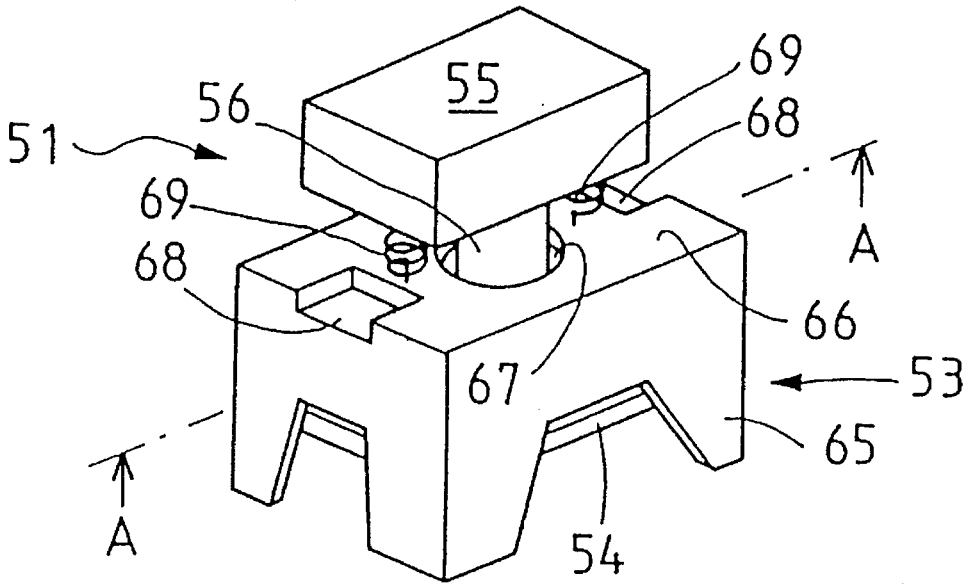
FIG. 22 is a perspective view of the stamp unit according to a third embodiment of this invention.

When the print is carried out a prescribed number of times, the ink impregnated in the impregnation member 127 is depleted, and thus, the impregnation member 127 must be replaced. In order to replace the impregnation member 127, the impregnation member itself is not replaced, but the stamp member 103 on which the impregnation member 127 is mounted is replaced. FIGS. 21(A), 21(B) and 21(C) show a replacement of the stamp member 103, and the replacement method is illustrated in FIG. 21(A) to FIG. 21(B) to FIG. 21(C) in this order.

Accordingly, when the stamp member 103 is removed, at the first position state, that is, in the state where the upper-side slant surfaces of the engaging pawls 136 formed on the outer-periphery holding member 105 abut against the projections 146 having the rectangular holes 142, the upper wall portion 141 of the skirt member 106 is pressed, and the grip member 102 is pulled up. In this state, the engaging windows 114A at the lower end of the grip member 102 are engaged with the engaging pawls 136 at the lower end portion, and by pulling up the grip member 102, the engaging pawls 136 abut against the projections 146, and the upward movement thereof 102 is prevented. By further pulling the grip member 102, the engaging pawls 136 are deformed inwardly as shown in FIG. 21(B) by a force acting on the lower-side slant surface of each engaging pawl 136, the engaging pawls 136 are separated from the engaging windows 114A, and the stamp member 103 falls down due to its weight so that the stamp member 103 is allowed to be removed.

Next, attachment of a new stamp member 103 having an impregnation member impregnated with ink will be described.

First, as shown in FIG. 21(A), the stamp member 103 on which the protection cap 107 is mounted is disposed so that the protection cap 107 abuts against a floor surface, and the skirt member 106 is covered on the stamp member 103 from the upper side. Thereafter, as shown in FIG. 21(B), the grip member 102 is downwardly pressed against the upwardly urging force of the compression spring 121 so that the foot portions 114 abut against the upper-side slant surfaces of the engaging pawls 136. By further pressing the grip member 102, the engaging pawls 136 are deformed inwardly. By further pressing the grip member 102 with the engaging pawls 136 inwardly deformed, the engaging windows 114A of the foot portions 114 are located at the projection portions of the engaging pawls 136, and the engaging pawls 136 so that the engaging pawls 136 are engaged with the engaging windows 114 as shown in FIG. 21(C).

The above description is made to the second embodiment of this invention. According to the stamp unit of this second embodiment, when replacement of a new impregnation member 127 is required due to ink consumption, the replacement can be performed without directly touching the stamp member 103, and an operator's hands are not stained by the ink.

Further, the stamp member 103 can be replaced by merely pulling up or pressing the grip member 102 so that the replacement can be easily and rapidly performed.

Still further, the protection cap 107 and the stamp member 103 can be maintained while unified into one body, and thus, no ink is attached to another element.

Next, a third embodiment of the stamp unit according to this invention will be described with reference to FIGS. 22 through 25.

As the first and second embodiments, the stamp unit of this embodiment comprises a grip member 51 to be grasped by a hand, a stamp member 52 that is fixedly linked to the grip member 51, a skirt member 53 covering the outer peripheral side of the stamp member 52, and a protection cap 54 that is freely detachably mounted on the stamp member 52.

The grip member 51 comprises a rectangular parallelepiped grip portion 55 and a link bar 56 that is fixed to the grip portion 55 and to an engaging plate 57. The engaging plate 57 is designed in a rectangular shape and has a flat upper surface side and a lower surface side whose longitudinal end portions are designed in a slant form.

As shown in the sectional view of FIGS. 24(A) and 24(B), the stamp member 52 comprises a stamp member body 58 and an outer-periphery holding member 59 that abuts against the protection cap 54 when the protection cap is mounted. The stamp member body 58 comprises a base member 61 that has a shallow recess portion 60 on a lower surface side and is formed of synthetic resin in a rectangular parallelepiped and hollow shape and a heat sensitive stencil paper 63 that is adhesively attached to the outer peripheral surface of the base member 61 with adhesive agent to cover the lower surface of an impregnation member 62 mounted on the recess portion 60 of the base member 61 and the outer peripheral side of the base member 61. Engaging pawls 64 are formed above the end portions of the base member 61 in the longitudinal direction. Each of the engaging pawls 64 is designed in a strip form to have a triangular projecting portion at the inner side of the upper end thereof, and the lower-side slant surface of each projecting portion is inclined upwardly.

The skirt member 53 is spaced from the end portions of the stamp member 58 and comprises an outer peripheral wall portion 65 into which the stamp member 58 is engagedly inserted so as to be freely slidable upwardly and downwardly and an upper wall portion 66 at the upper end of the stamp member 58. The lower end portions at the central portions on the four surfaces of the outer peripheral wall 65 of the skirt member 53 are partially cut out. A through hole 67 through which the link bar 56 penetrates is formed at the center of the upper wall portion 66, and recesses 68 are formed at the center positions of the corner sides in the longitudinal direction of the upper wall portion 66.

The stamp member 52 is engagedly inserted into the skirt member 53 when the engaging pawls 64 of the stamp member 52 are engaged with the engaging plate 57 of the grip member 51, and the link bar 56 fixed onto the upper surface of the engaging plate 57 is disposed to penetrate through the through hole 67 formed on the upper wall portion 66 of the skirt member 53. The grip portion 55 of the upper portion of the link bar 56 is upwardly urged by the compression spring 69 whose one end is fixedly secured to the upper wall portion 66 of the skirt member 53. The protection cap 54 is designed so that the outer peripheral portion thereof abuts against the outer-periphery holding member 59 from the lower side of the stamp member 52 and is engaged with the base portion 61 to protect the print face portion.

Figure 25A:
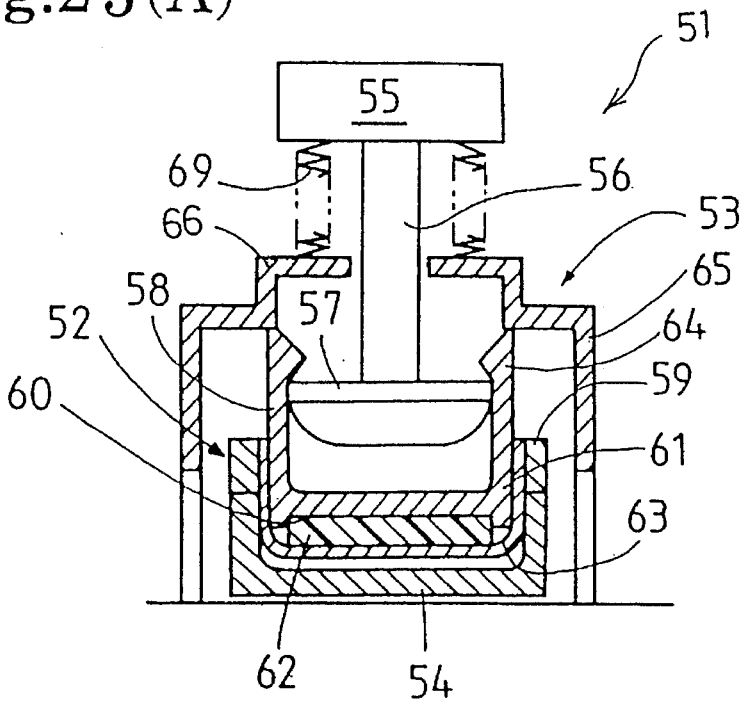
FIG. 25(A) is a sectional view showing a detachment state of the stamp member according to the third embodiment.
Figure 25B:
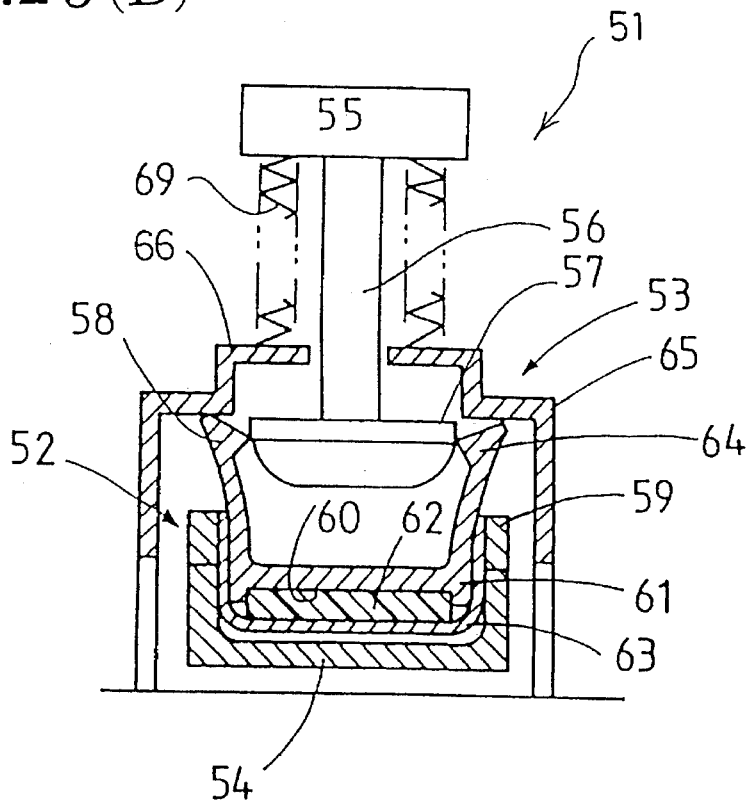
FIG. 25(B) is a sectional view showing a detachment state of the stamp member 52 according to the third embodiment.

The attachment and detachment of the stamp member to and from the stamp unit of this embodiment thus constructed are performed as follows. FIGS. 24(A) and 24(B) show an attaching state, and FIGS. 25(A) and 25(B) show a detaching case. Each figure is a longitudinal-sectional side view of the stamp unit.

First, the stamp member 52 is attached as shown in FIGS. 24(A) and 24(B). Specifically, as shown in FIGS. 24(A), the stamp member 52 is disposed on a floor surface while the protection cap 54 is engagedly mounted on the lower portion of the stamp member 52 and covered by the skirt member 65 unified to the grip member 51 from the upper side while matching the longitudinal directions thereof with each other. Thereafter, as shown in FIG. 24(B), when the grip member 51 is pressed while the lower end of the skirt member 65 contacts the floor surface, the grip member 51 is downwardly moved against the urging force of the compression spring 69, and the end portions of the lower surface of the engaging plate 57 abut against the engaging pawls 64. At this time, by further pressing the grip member 51 downwardly, the slant surfaces of the end portions of the engaging plate 57 act on the outer sides of the engaging pawls 64, and the engaging pawls 64 are outwardly extended.

Figure 23:
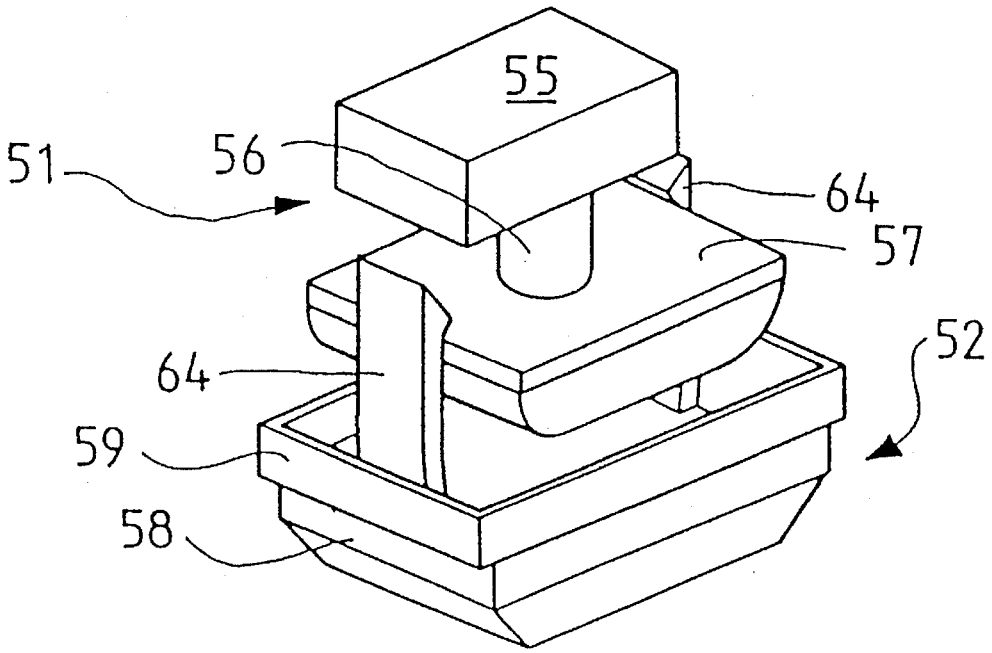
FIG. 23 is a partial perspective view of the stamp unit according to the third embodiment of the invention.
Figure 24:
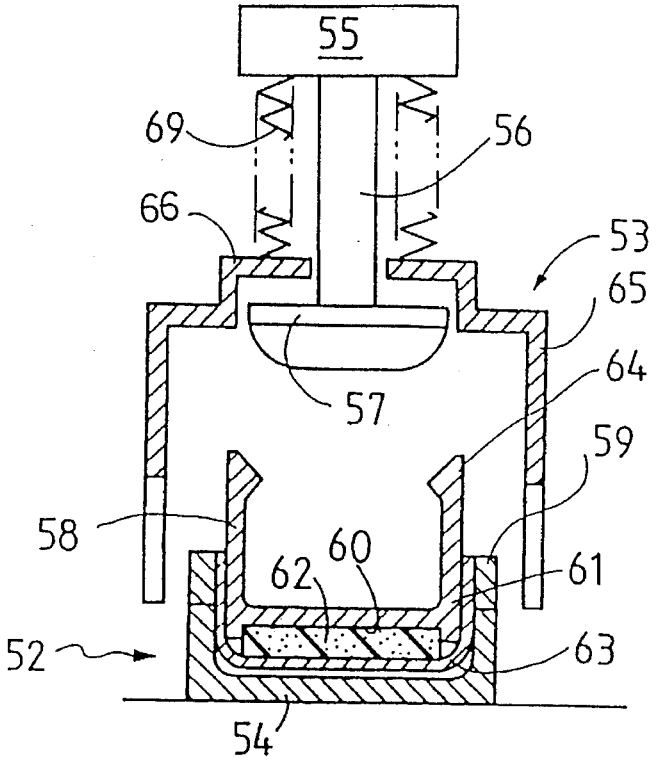
FIG. 24(A) is a sectional view showing an attachment state of the stamp member according to the third embodiment.
FIG. 24(B) is a sectional view showing an attachment state of the stamp member according to the third embodiment.
Figure 24:
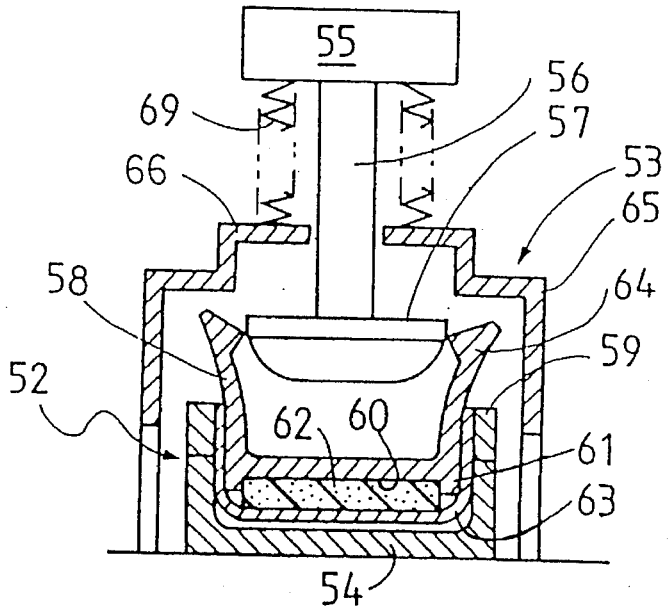

Thereafter, when the grip member 51 is further pressed by a predetermined amount until the slant surfaces pass over the triangular projecting portions of the engaging pawls 64, the deformation is released, and the triangular projecting portions are engaged with the engaging plate 57 so that the stamp member 52 is fixed as shown in FIG. 23.

Subsequently, the stamp member 52, which is fixed as shown in FIGS. 25(A) and 25(B), is removed as follows. Specifically, as shown in FIG. 25(A), the grip member is pulled up in the state where the skirt member 65 is downwardly pressed to press the skirt member 65 against the floor surface. As a result, the fixed stamp member 52 is lifted up with the grip member 51, and the engaging pawls 64 engaged with the engaging plate 57 abut against the recess 68 of the upper wall portion 66 of the skirt member 65, whereby the upward movement of the grip member 51 is restricted. When the grip member 51 is further pulled up, as shown in FIG. 25(B), the corner portions of the engaging plate 57 act on the lower-side slant surfaces of the engaging pawls 64 to extend the engaging pawls 64 outwardly. Therefore, when the engaging plate 57 is engagedly inserted into an upper space 70 of the skirt member 53, which is formed by the recess 68, the engaging pawls 64 are detached from the engaging plate 57 and fall down, and the stamp member is detached.

As described above, according to this embodiment, through the engagement between the engaging pawls 64 and the engaging plate 57, the stamp member is attached. Therefore, the attachment and the detachment of the stamp member can be easily performed.

Further, the engaging pawls 64 are designed in a large size to make a strong engagement with the engaging plate 57 so that it can be firmly fixed, and the print can be stably performed.

The above description is made to an embodiment of the stamp unit. However, this invention is not limited to the above embodiment, and various modifications may be made without departing from the subject matter of the invention.

For example, in the above embodiment, each engaging pawl is designed in a triangular projecting shape, however, it may be designed to have a slant surface at the engaging securing side thereof, and no restriction is imposed on its shape.

What is claimed is:

1. A stamp unit comprising:

a grip portion having first guide holes extending in a substantially horizontal direction;

a stamp portion engageable with the grip portion, said stamp portion comprising:

a base member, an ink member fixed to a lower surface of said base member, and a heat sensitive stencil paper covering at least a lower surface of said ink member and comprising a print face portion;

a skirt member surrounding an outer peripheral side of said stamp portion, said skirt member having second guide holes, said skirt member being supported by at least one of said grip portion and said stamp portion so as to be movable relative to said ink member in a substantially vertical direction between a first position at which a lower end portion of said skirt member protects beyond said print face portion of said stamp portion, a second position at which said lower end portion of said skirt member does not protect beyond said print face portion, and a third position in which said first guide holes are maintained in alignment with said second guide holes such that an alignment device is receivable therethrough; and an elastic member that elastically urges said skirt member toward said first position relative to said grip portion.

2. The stamp unit as claimed in claim 1, wherein said stamp portion has an outer-periphery holding member surrounding an outer peripheral portion of said heat sensitive stencil paper and extending toward an outer peripheral side of said base member at an inside of said skirt member.

3. The stamp unit as claimed in claim 1, further comprising a protection cap covering said print face portion of said stamp portion, said protection cap being freely detachably mounted on said stamp portion.

4. The stamp unit as claimed in claim 3, wherein said stamp portion further comprises an outer-periphery holding member that surrounds an outer peripheral portion of said heat sensitive stencil paper, and wherein an upper end of said protection cap abuts a lower end of said outer-periphery holding member and surrounds said outer peripheral portion such that said protection cap remains spaced from said print face portion.

5. The stamp unit as claimed in claim 1, wherein said skirt member further comprises at least one lower edge relieved portion that remains above and spaced from a printing surface, said skirt member being formed of a transparent material to facilitate positioning of the print face portion in a desired print position.

6. The stamp unit as claimed in claim 1, wherein said heat sensitive stencil paper is perforated in a dot pattern to form plural characters.

7. The stamp unit as claimed in claim 6, wherein said grip portion has a guide groove formed at each of lower portions of a front wall and a rear wall thereof in order to maintain said grip portion at a predetermined position when the dot pattern is perforated.

8. The stamp unit as claimed in claim 1, wherein said ink member comprises an impregnation member impregnated with ink.

9. The stamp unit as claimed in claim 1, wherein said grip portion has a recess portion formed at a top portion of said grip portion, said recess portion adapted to receive a label for distinguishing said stamp unit.

10. The stamp unit as claimed in claim 1, wherein said stamp portion is fixed to said grip portion.

11. The stamp unit as claimed in claim 10, further comprising means for removably fixing said stamp portion to said grip portion.

12. The stamp unit as claimed in claim 1, wherein one of said stamp portion and said grip portion comprises at least one engaging pawl and the other of said stamp portion and said grip portion comprises a corresponding at least one engaging window releasably engageable with said at least one engaging pawl.

13. A stamp unit comprising:

a grip member;

a stamp member engageable with a lower surface of said grip member, said stamp member comprising a print face portion having an ink member impregnated with ink and a heat sensitive stencil paper covering the ink member, wherein one of said stamp member and said grip member comprises at least one engaging pawl and the other of said stamp member and said grip member comprises a corresponding at least one engaging window releasably engageable with said at least one engaging pawl;

a skirt member connected to said grip member, said skirt member being freely movable in an upward and downward direction relative to said grip member while surrounding an outer periphery of said stamp member; and an engagement releasing piece abutting against each of said at least one engaging pawl when said grip member is moved relative to said skirt member, said engagement releasing piece elastically deforming each of said at least one engaging pawl to disengage each said at least one engaging window from each said at least one engaging pawl.

14. The stamp unit as claimed in claim 13, wherein said stamp member is fixed to said grip member.

15. The stamp unit as claimed in claim 13, wherein said skirt member further comprises at least one lower edge relieved portion that remains above and spaced from a printing surface, said skirt member being formed of a transparent material to facilitate positioning of the print face portion in a desired print position.

* * * * *